US009941642B1

(12) United States Patent
Waggoner

(10) Patent No.: US 9,941,642 B1
(45) Date of Patent: Apr. 10, 2018

(54) ELECTRICAL OUTLET COVER WITH EXCESS CORD STORAGE

(71) Applicant: Kevin Waggoner, Austin, TX (US)

(72) Inventor: Kevin Waggoner, Austin, TX (US)

( * ) Notice: Subject to any disclaimer, the term of this patent is extended or adjusted under 35 U.S.C. 154(b) by 0 days.

(21) Appl. No.: 13/938,300

(22) Filed: Jul. 10, 2013

Related U.S. Application Data

(63) Continuation-in-part of application No. 13/686,309, filed on Nov. 27, 2012, now abandoned, which is a continuation-in-part of application No. 13/310,549, filed on Dec. 2, 2011, now Pat. No. 8,734,181.

(60) Provisional application No. 61/419,819, filed on Dec. 4, 2010.

(51) Int. Cl.
*H01R 13/72* (2006.01)
*H01R 13/66* (2006.01)

(52) U.S. Cl.
CPC ..... *H01R 13/66* (2013.01)

(58) Field of Classification Search
CPC ..... H01R 13/66; H01R 25/003; H02G 11/02
USPC .... 439/501–502, 4, 651–652, 532, 535–536, 439/545; 174/48, 53, 66
See application file for complete search history.

(56) References Cited

U.S. PATENT DOCUMENTS

| | | | | |
|---|---|---|---|---|
| 3,257,497 | A * | 6/1966 | Chase | 174/66 |
| 3,689,868 | A * | 9/1972 | Snyder | H02G 11/02 174/66 |
| 4,520,239 | A * | 5/1985 | Schwartz | 191/12.4 |
| 5,657,841 | A * | 8/1997 | Morvan | 191/12.4 |
| 5,700,150 | A * | 12/1997 | Morin | 439/4 |
| 5,700,158 | A * | 12/1997 | Neiser et al. | 439/501 |
| 5,917,694 | A * | 6/1999 | Denny | 361/643 |
| 6,077,109 | A * | 6/2000 | Prazoff | H01R 25/003 191/12.4 |
| 6,135,810 | A * | 10/2000 | Damson et al. | 439/501 |
| 6,200,159 | B1 * | 3/2001 | Chou | 439/535 |
| 6,346,006 | B1 * | 2/2002 | Smith | 439/501 |
| 6,503,097 | B2 * | 1/2003 | Archambault | 439/501 |

* cited by examiner

*Primary Examiner* — Jean F Duverne
(74) *Attorney, Agent, or Firm* — Rick B. Yeager

(57) ABSTRACT

A receptacle cover plate assembly for an all-in-one receptacle with one or more electrical outlets and USB ports. A flange plate has rearward angular flanges which project back toward the wall of a structure. The flange plate conceals cord wrapped around a spool plate. The spool plate is provided as part of a combined receptacle, receptacle cover plate and spool plate where a spool cover is offset from a receptacle cover plate face.

10 Claims, 43 Drawing Sheets

ELECTRICAL OUTLET COVER WITH EXCESS CORD STORAGE

RELATED APPLICATIONS

This is a continuation in part application of U.S. patent application Ser. No. 13/686,309 filed on Nov. 27, 2012 by applicant, which was a continuation in part application of U.S. patent application Ser. No. 13/310,549 filed on Dec. 2, 2011 by applicant which is related to U.S. Provisional Application No. 61/419,819, which was filed Dec. 4, 2010, and claims the priority of that Dec. 4, 2010 filing date. This application is also related to U.S. Provisional Application No. 61/524,749 which was filed on Aug. 17, 2011.

TECHNICAL FIELD OF THE INVENTION

The present invention generally relates to ordering systems for cords for connection between devices and wall receptacles.

BACKGROUND OF THE INVENTION

Many devices require the use of cords to connect the device for receiving electrical power from a power main socket. For example small appliances like an electric shaver or the charging station of an electric shaver have power cords that plug into a wall socket. Since the manufacturer of the device cannot anticipate the distance from the power receptacle and the users desired position of the device, a standard cord length is used. This typically results in extra cord. This extra cord length creates clutter which is unsightly and can create safety risks. Some devices provide a solution by providing mechanisms for storage of the extra cord. However most devices do not.

FIGS. 1 and 2 illustrate a prior art common sight around the world as described in the background section above. Almost everyone, if not everyone that has worked with electric devices has experienced dealing with extra cord length. Frequently the cord is left loose as illustrated in FIG. 1 or is makeshift bundled as illustrated in FIG. 2 in both situations are unsafe and suboptimal. Though not shown in the FIG. 1 and FIG. 2 the same applies for data communication cords such as phone cords, ethernet cords, USB cables, coaxial cables, audio visual cables or similar cords containing electrical or optical or other types of signals carrying signals that contain therein data.

In some cases the data and power links may be combined as is the case for standard telephone links.

There is a need for a device that stows away extra cord lengths which are useful for linkages such as power links and/or data links.

BRIEF DESCRIPTION OF THE DRAWINGS

For a more complete understanding of the present invention and the advantages thereof, reference is now made to the following description taken in conjunction with the accompanying drawings in which like reference numerals indicate like features and wherein:

FIG. 40A is an exploded side view of a combination spool/outlet plate and a flush outlet cover plate with two USB slots in the cover and a DC charger attached or piggy-backed to the backside of the receptacle.

DESCRIPTION OF EMBODIMENT—3-PART RECEPTACLE COVER PLATE ASSEMBLY WITH SPOOL PLATE, FLANGE PLATE WITH FLEXIBLE FLANGES, AND RECEPTACLE PLATE

Embodiments of the present disclosure are illustrated in the FIGS., like numerals being used to refer to like and corresponding parts of the various drawings. FIGS. 3-22 illustrate 3-part receptacle cover plate assembly 100 where a flange plate 120 with flexible flanges is positioned between a spool plate 140 and a receptacle cover plate, or "receptacle plate" 114. A portion of the space between the flange plate 120 and the spool plate 140 is used to wrap excess cord, and rearward angular flanges 128, also called "out flanges", are used to conceal the cord.

Figure 3:
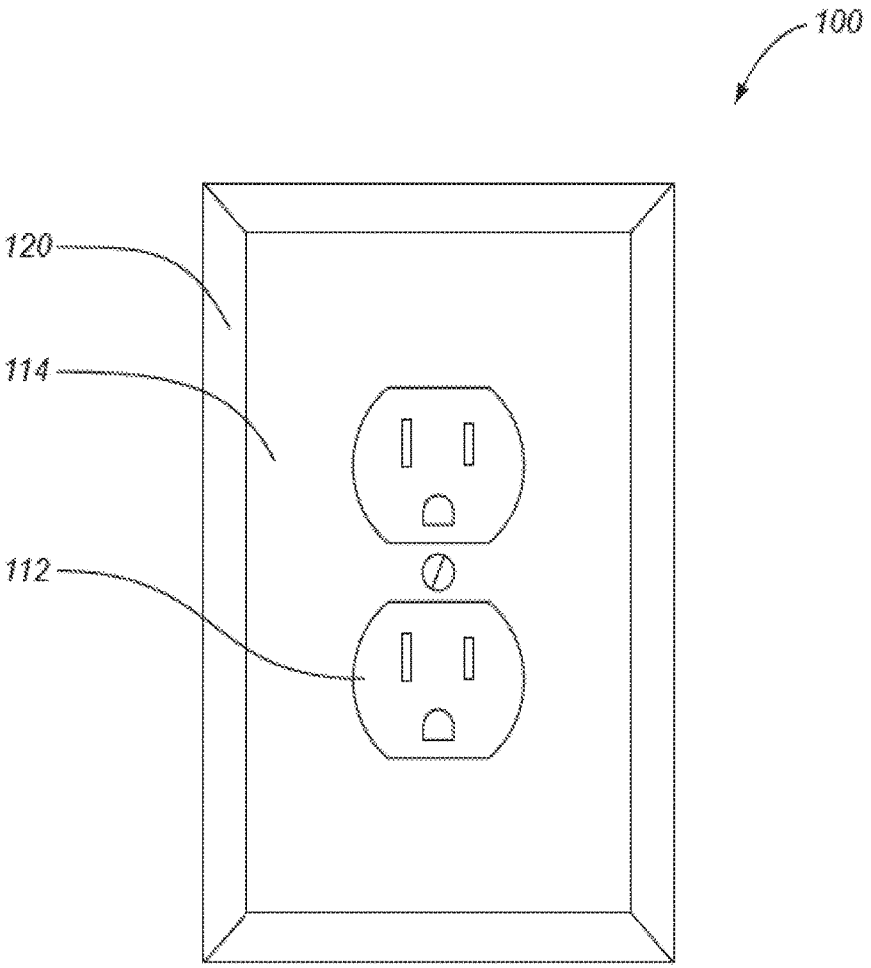
FIG. 3 illustrates an embodiment of a receptacle cover plate assembly.
Figure 4:
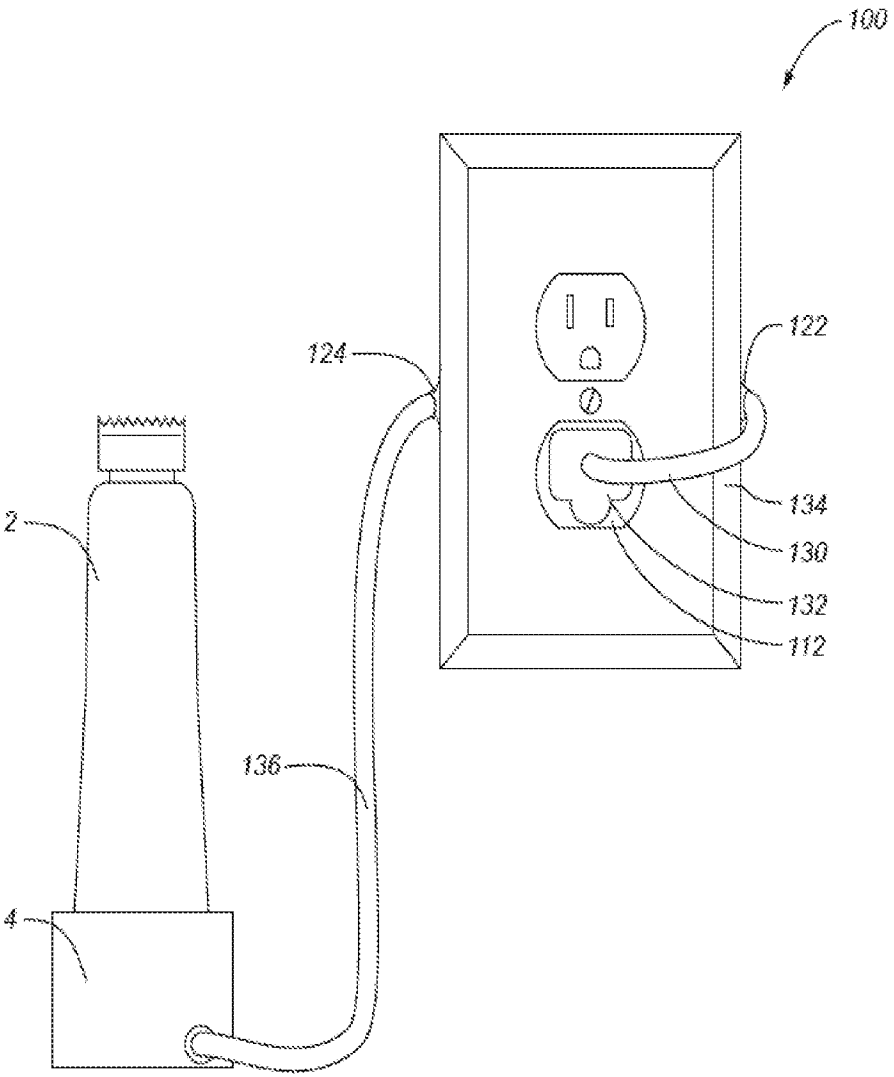
FIG. 4 illustrates the embodiment of the receptacle cover plate assembly illustrated in FIG. 3 in use.
Figure 5:
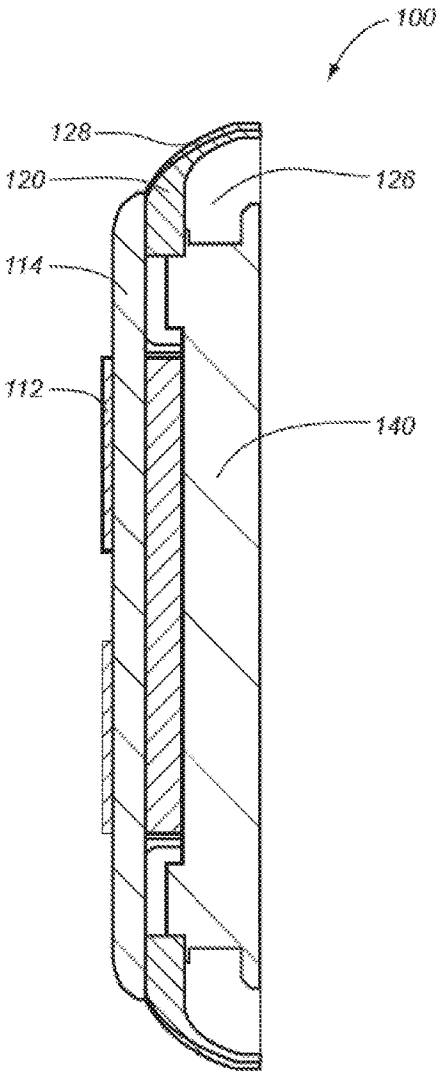
FIG. 5 illustrates a side cross-section of the embodiment illustrated in FIG. 3.

FIG. 5 illustrates a side cross-section of the embodiment of the receptacle cover plate assembly 100 illustrated in FIG. 3. In this view the receptacle 112 is seen with the receptacle plate 114. The flange plate 120 can also be seen. This view also illustrates the spool plate 140. The space 126 around the outer edges between the spool plate 140 and the flange plate 120 is the location where the extra length of cord (not shown in FIG. 29) is stored.

The cord (now shown) enters the space 126 via the out flanges 128 of the flange plate 120. In this embodiment, the flanges are compliant, so that a portion of a flange may be bent outward, away from the receptacle box or wall, in order to provide room to wrap the cord on the spool plate behind the flange. In other embodiments, the flanges are not compliant, and the flange plate may be formed of a single material.

Figure 6:
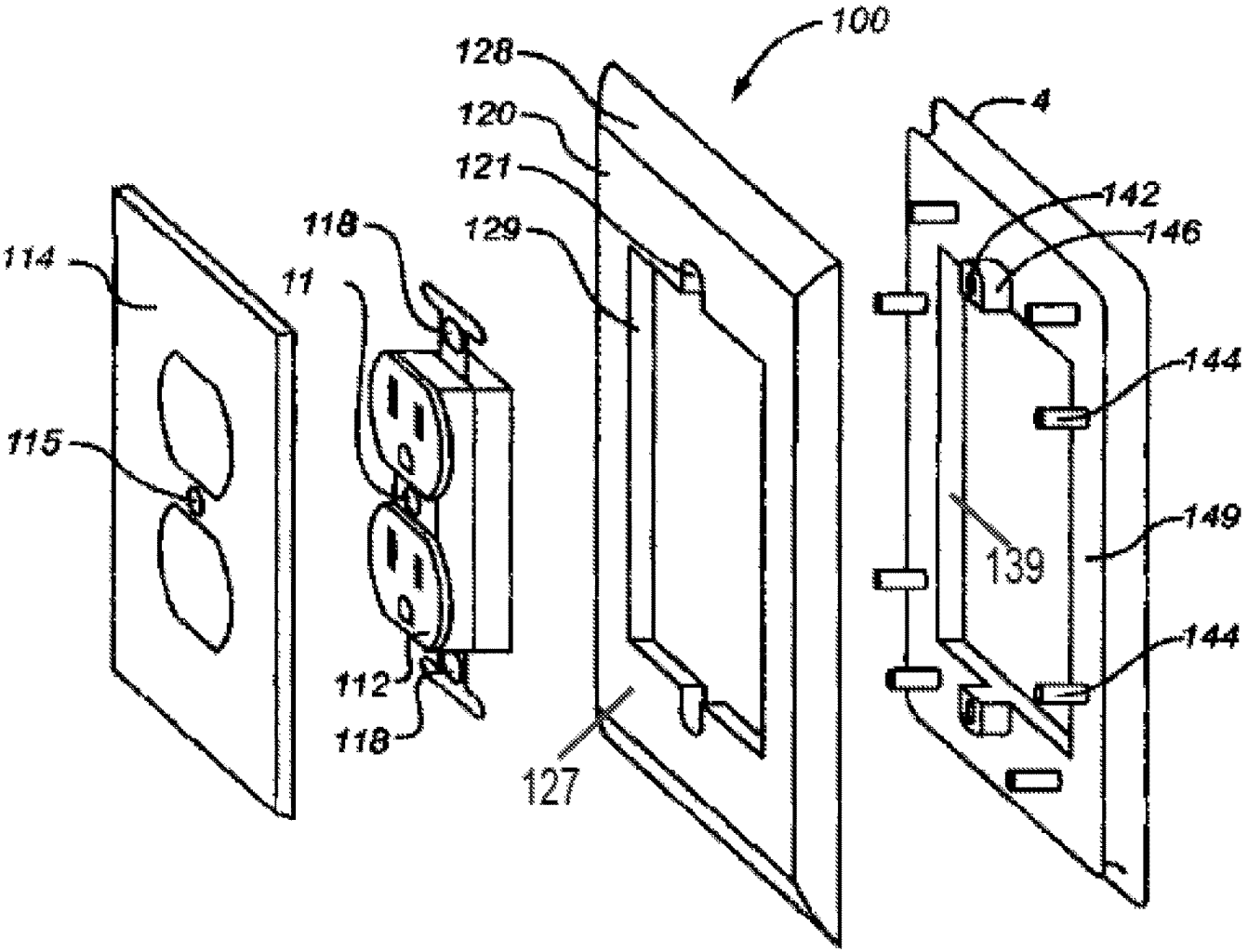
FIG. 6 illustrates an exploded view of the components of the embodiment illustrated in FIG. 3.

FIG. 6. illustrates an exploded view of the components of the embodiment of the cord stowage device 100 illustrated in FIG. 3. Proceeding from left to right the components illustrated include the receptacle plate 114, the receptacle 112, the flange plate 120 and the spool plate 140. The receptacle plate 114 connects to the receptacle 112 using a threaded bolt/screw (not shown) through hole 115 to the threaded receiving hole 111 of the receptacle 112 in a standard manner. In the embodiment shown receptacle 112 is connected a receptacle knockout box (not shown) which is connected to a wall type structure (also not shown) with a threaded bolt (not shown) through mounting holes 118 through indents 121 of the flange plate 120 and through-hole 142 of the spool plate 140. Thereby the flange plate 120 and spool plate 140 are sandwiched between the receptacle 112 and the wall (not shown). In this figure, extensions 144 from the backplate can be seen. These extensions nest with holes (not seen) in the flange plate 120 to help to hold the flange plate in place during use.

In this specification, the term "receptacle box" refers to a plastic or metal box designed for connecting to a wiring system and mounting surface wiring devices such as electrical outlets, switches, telephone jacks, and cable connections. In prior art, a flush-mounted cover plate is attached to the box or to a electric outlet in the box. In several examples of the current invention, the conventional cover flush-mounted plate is replaced with a cover device which provides a spool plate offset from the wall so that cord can be wrapped around the spool plate; and a flange plate for concealing the wrapped cord. In some examples, the receptacle is mounted in the receptacle box, and in other examples the receptacle is offset from the wall and mounted with resect to the spool plate or the flange plate.

Figure 7:
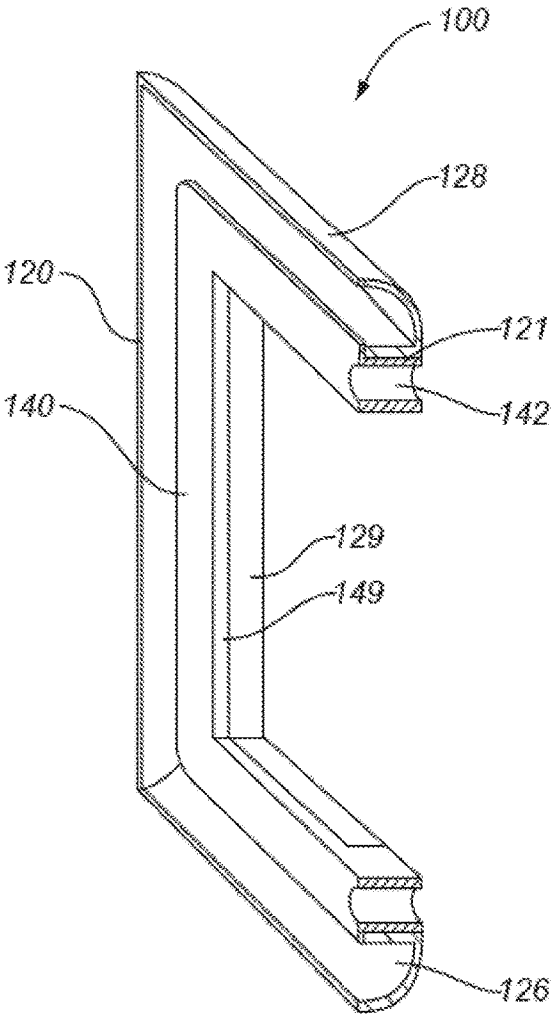
FIG. 7 illustrates a perspective view cross-section of the flange plate components of the embodiment illustrated in FIG. 3.

FIG. 7. illustrates a perspective view cross-section of the flange plate 120 component of the cord stowage device 100 embodiment illustrated in FIG. 3. From this figure, it can be appreciated how the flange plate 120 nests on the spool plate 140 to create the cord storage space 126. In particular it can be seen how indent 121 of the flange plate 120 nest around the through-hole 142 process 146 of the spool plate 140.

Figure 8:
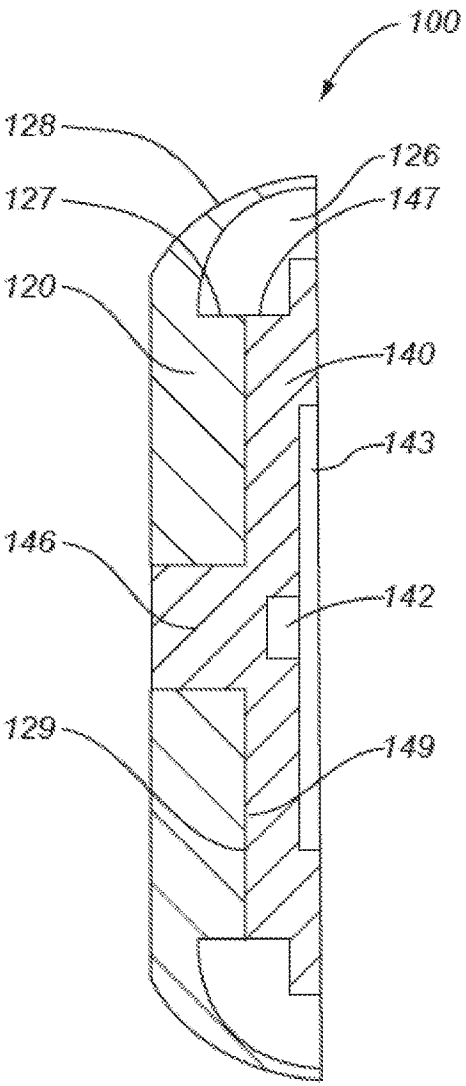
FIG. 8 illustrates a cross-section top view of the spool plate and flange plate components of the embodiment illustrated in FIG. 3.
Figure 9:
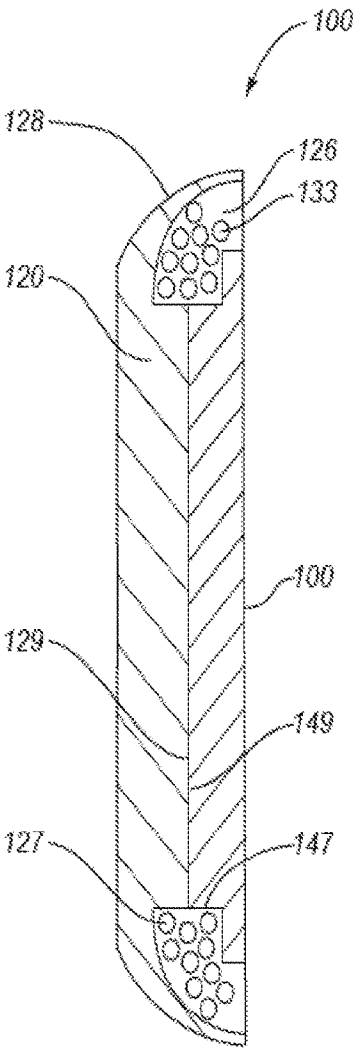
FIG. 9 illustrates a cross-section view of the spool plate and flange plate components of the embodiment illustrated in FIG. 3 in use to stow a length of power cord.

FIG. 8 and FIG. 9 illustrate cross-sectional views of the spool plate 140 and flange plate 120 components of the embodiment 100 illustrated in FIG. 3. These FIGS. show the openings 129 and 149 of the flange plate and backplate respectively for allowing the receptacle to nest into the knockout box (not shown). Element 129 is a flange plate window. FIG. 9 illustrates a section 133 of cord being stowed in the stowage space 126 created between the flange plate 120 and spool plate 140. From FIG. 9 in can be appreciated that together the flange plate and spool plate surface 147 provide surfaces against which the cord can be spooled. Cavity openings 142 provide spaces to receiving mounting screw heads allowing the spool plate 140 to fit flush to the wall (not shown). Recess 143 provides a cavity accept/provide space for the receptacle ears (not shown in FIG. 9). The screw receptacle cavity 142 on the back plate provides for stability when the screw goes through the backplate to mount it to the knockout box (not shown).

Figure 10:
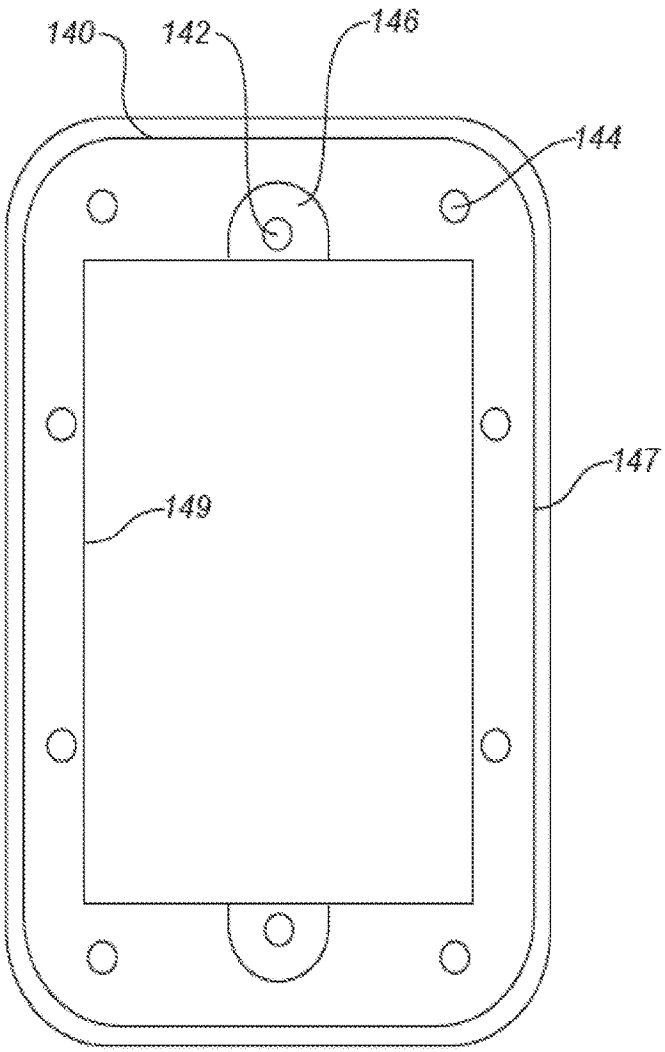
FIG. 10 illustrates a front view of the spool plate of the embodiment illustrated in FIG. 3.

FIG. 10 illustrates a front view of the spool plate 140 of the embodiment illustrated in FIG. 27. This figure shows the location of the processes 146 and 144 which nest with the flange plate 120 indents (not shown).

Figure 1:
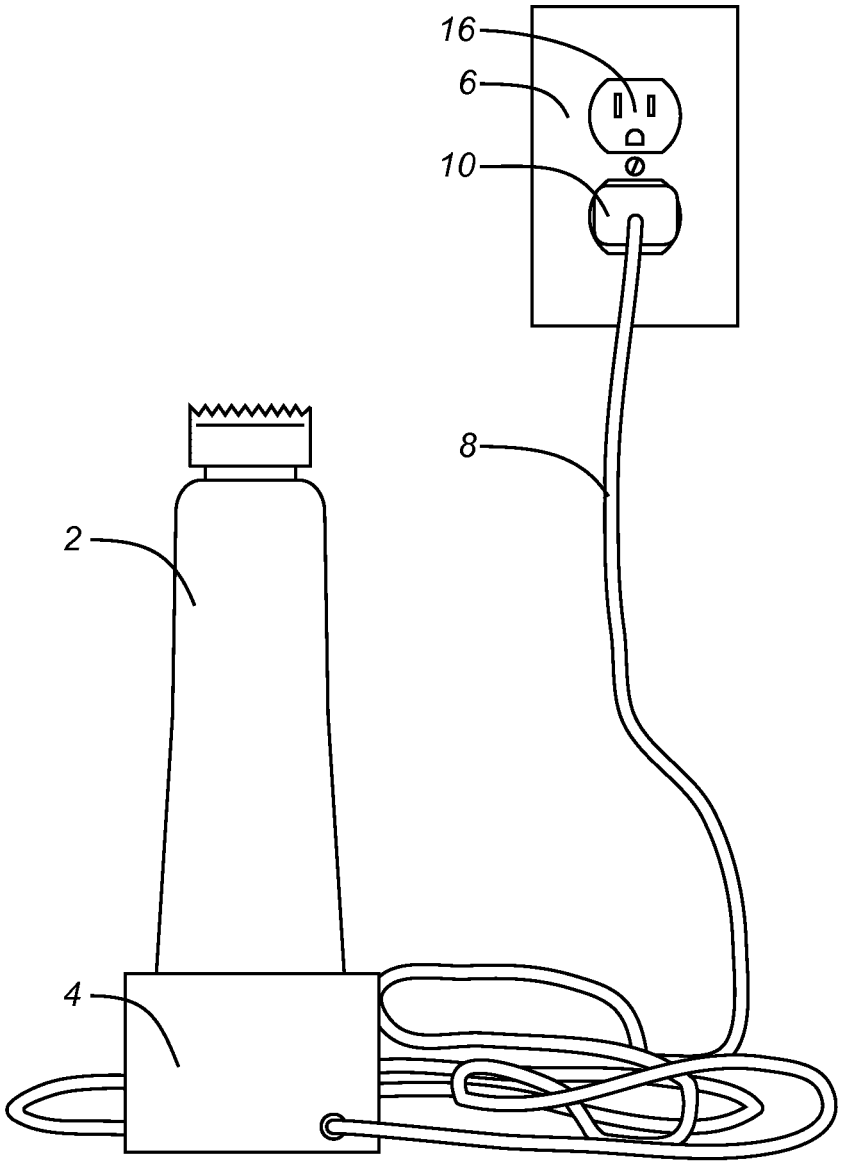
FIG. 1 (PRIOR ART)
FIG. 1 illustrates a prior art configuration of an electric appliance connection to mains power.
Figure 2:
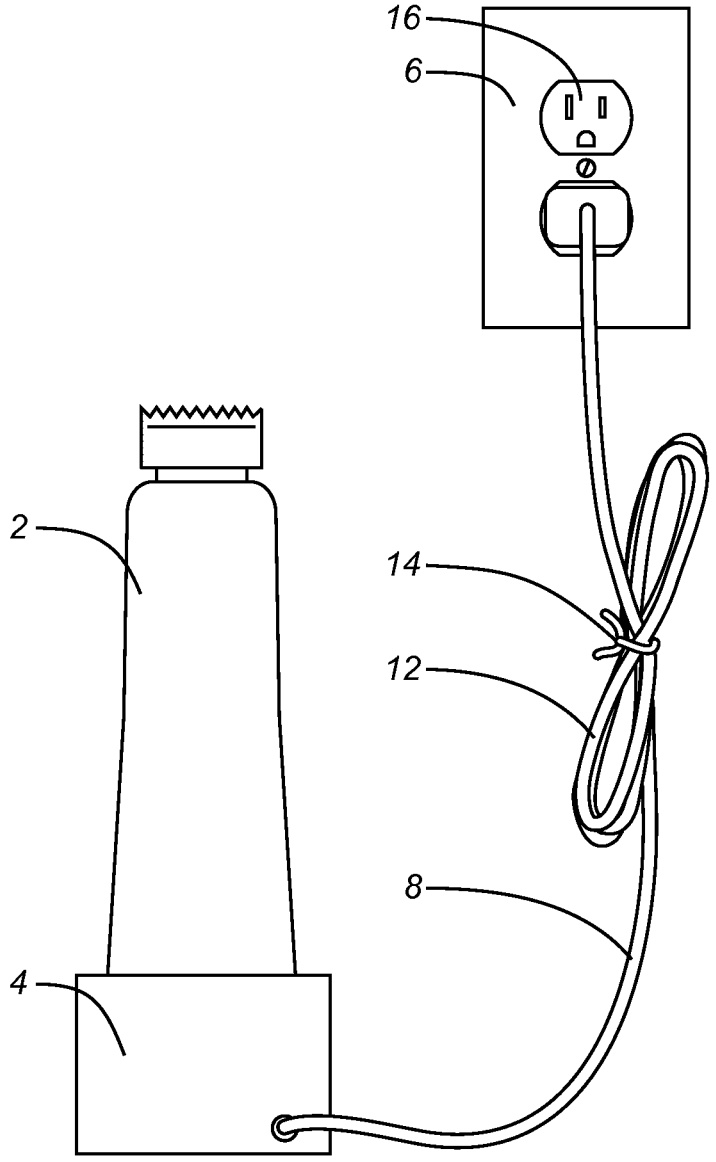
FIG. 2 (PRIOR ART)
FIG. 2 illustrates a prior art configuration of an electric appliance connection to mains power.
Figure 11:
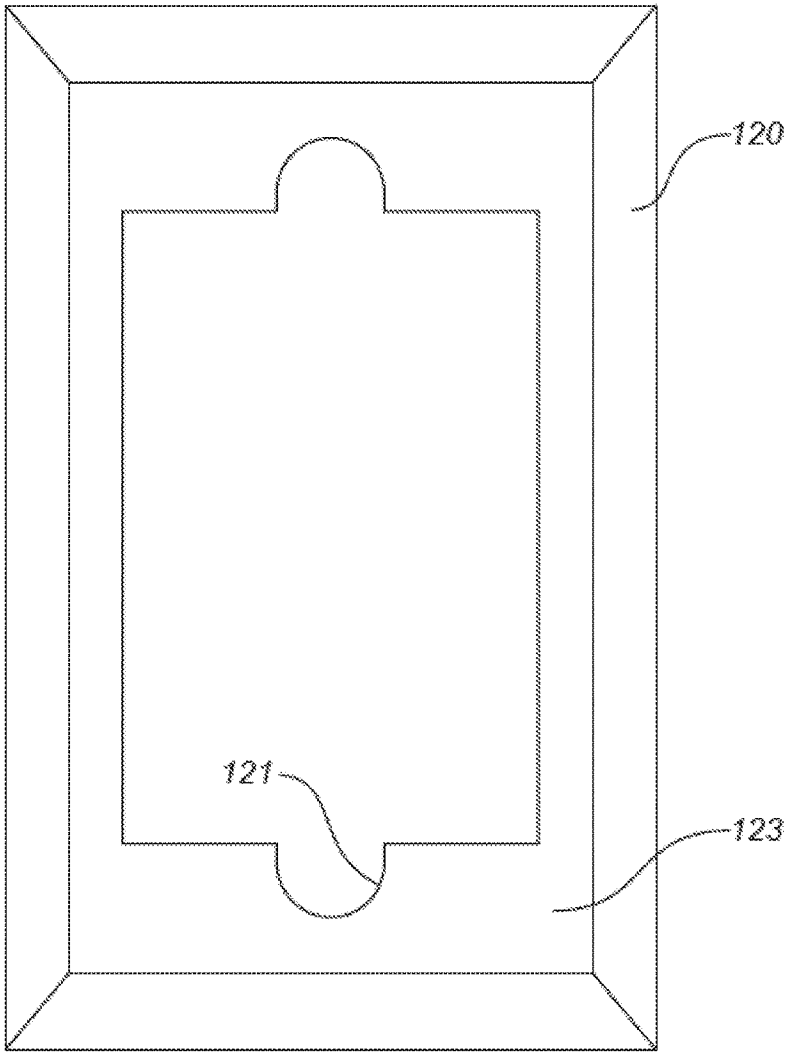
FIG. 11 illustrates a front view of the flange plate of the embodiment illustrated in FIG. 3.

FIG. 11 illustrates a front view of the flange plate 120 of the embodiment illustrated in FIG. 1. This side of the flange plate 120 faces the receptacle plate (not shown) and recess plate of the embodiment illustrated in FIG. 13 (not shown). In the embodiment shown, flange plate 120 has a profile 123 to line up to standard plate and recess plate.

Figure 12:
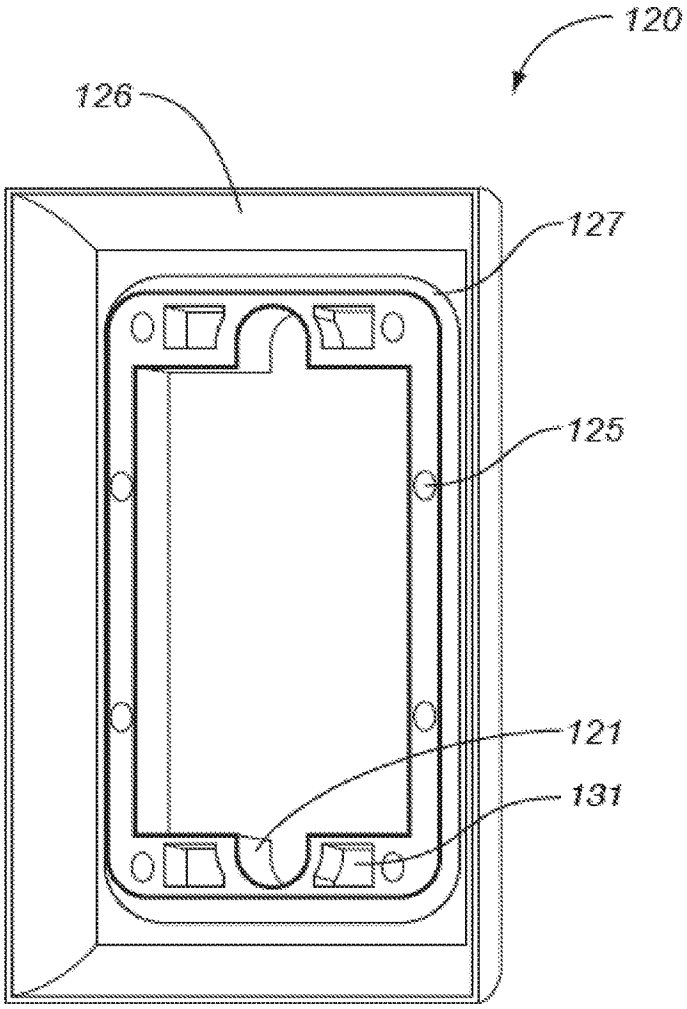
FIG. 12 illustrates a back perspective view of the flange plate of the embodiment illustrated in FIG. 3.

FIG. 12 illustrates a back perspective view of the flange plate 120 of the embodiment illustrated in FIG. 3. In FIG. 12 the indents 125 for receiving the processes 144 (shown in FIG. 34) of the spool plate 140. As previously described, this nesting keeps the flange plate 120 in place during use. FIG. 12 also shows forming gaps 131 which serve the purpose of preventing shrinkage divots which are sometimes caused by material shrinkage during the forming process.

Figure 22:
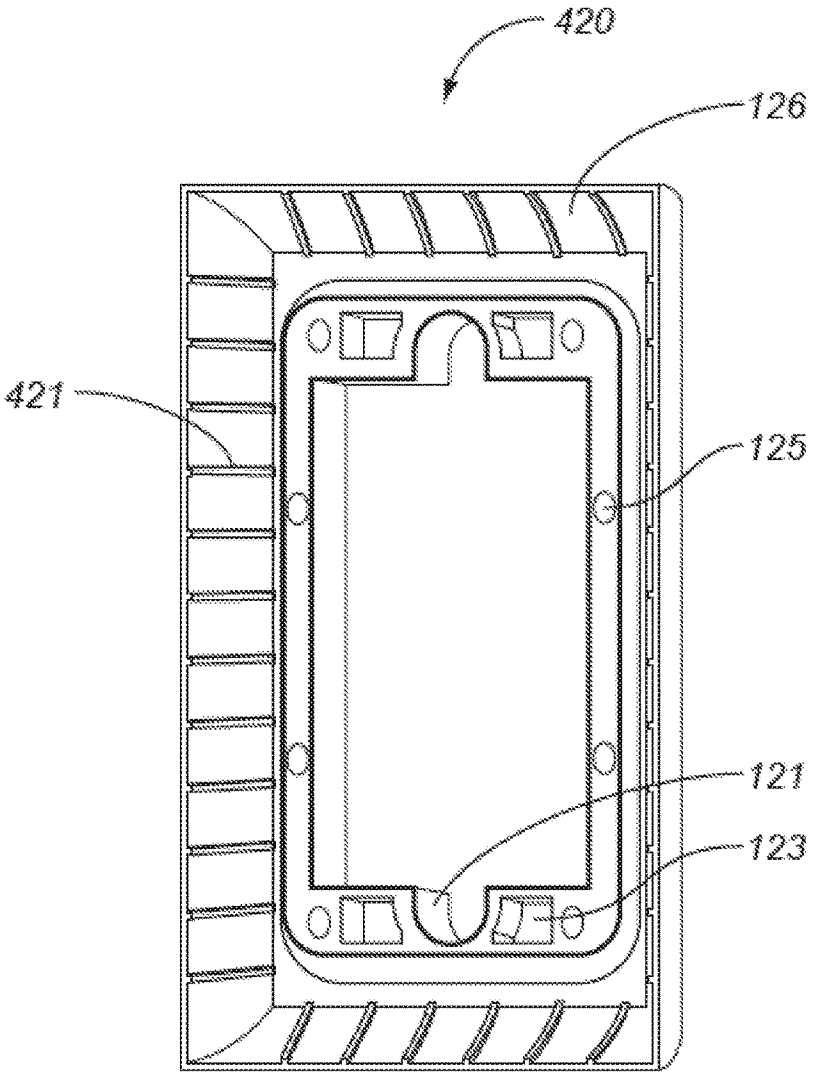
FIG. 22 illustrates an alternative embodiment of the flange shown in the previously illustrated embodiments where the flange has ribs.

FIG. 22 illustrates an embodiment of a flange plate with rib sections 421 on portions of the sidewall, also called flanges, of the flange plate 420. In this embodiment, the ribs are on the inside wall. In other embodiments the ribs may be on the outside wall or both inside and outside walls. The purpose of the ribs is to provide more rigidity or structural integrity while using less material. The use of the ribs and their size number and placement depend on the flexible material chosen for the flanges.

In this embodiment, the flange plate 420 has flexible flanges which can be bent forward to allow a cord to be wrapped behind the flange plate. In other embodiments, the flange plate may be rigid, and not installed until a cord is wrapped around the spool plate.

DESCRIPTION OF EMBODIMENT—2-PART RECEPTACLE COVER PLATE ASSEMBLY WITH COMBINED SPOOL PLATE AND FLANGE PLATE

In this embodiment, the device of FIGS. 3-12 provides a combined flange plate 120 and spool plate 140. In this example, the combined flange plate and spool plate can be produced as a single part, such as by injection molding, or the separate parts may be fabricated and attached.

DESCRIPTION OF EMBODIMENT—3-PART RECEPTACLE COVER PLATE ASSEMBLY WITH SPOOL PLATE, FLANGE PLATE, AND RECESSED RECEPTACLE PLATE

Figure 13:
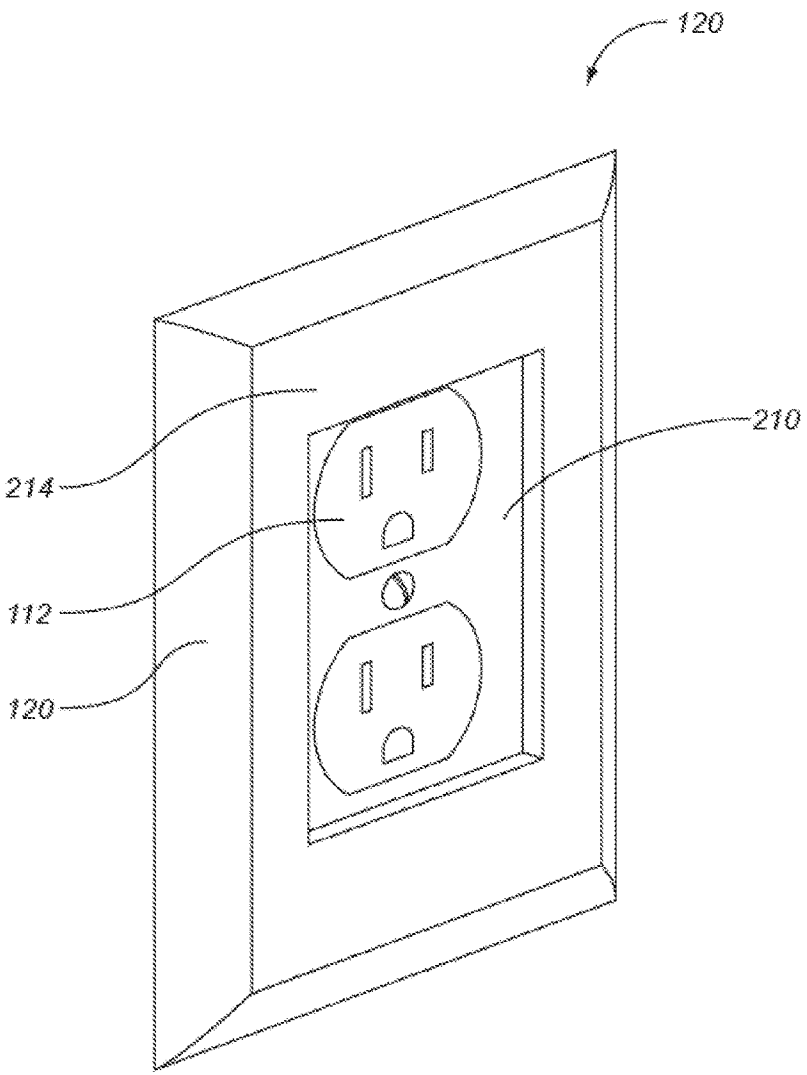
FIG. 13 illustrates another embodiment of a cord storage device similar to the embodiment in FIG. 3 but where the receptacle is recessed.

FIG. 13 illustrates an alternative embodiment 200 of a receptacle cover plate assembly. In this embodiment the power receptacle(s) 112 are recessed but are otherwise the same standard power receptacle(s). The receptacle plate 214 is recessed 210. In the embodiment shown the flange plate 120 is the same as the flange plate in the embodiment illustrated in FIGS. 3-12.

Figure 14:
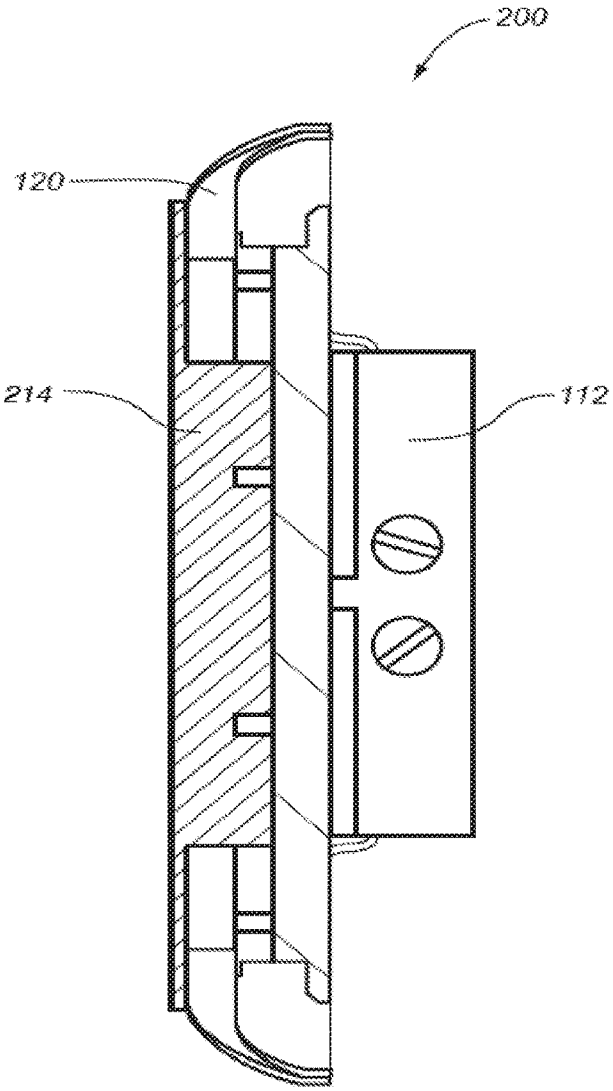
FIG. 14 illustrates a side cross-section of the embodiment illustrated in FIG. 37.

FIG. 14 illustrates a side cross-sectional view of the embodiment of FIG. 13 showing the receptacle 112 flange plate 120 and recessed receptacle plate 214.

Figure 15:
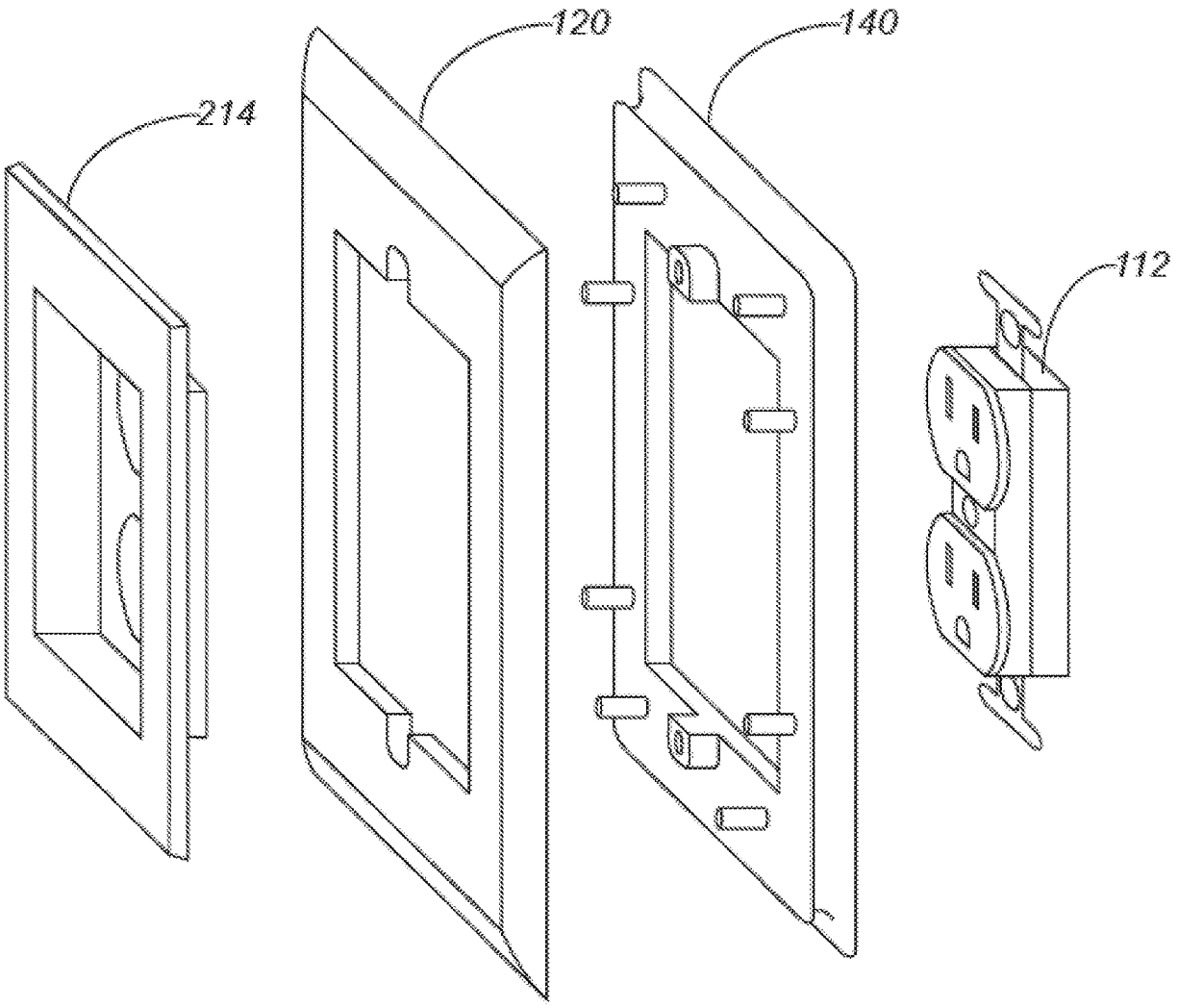
FIG. 15 illustrates an exploded view of the components of the embodiment illustrated in FIG. 13.

FIG. 15 illustrates an exploded view of the embodiment illustrated in FIG. 13. In this view the device can be seen disassembled showing separately the recessed receptacle plate 214; the flange plate 120; the spool plate 140 and the power receptacle 112.

Figure 16:
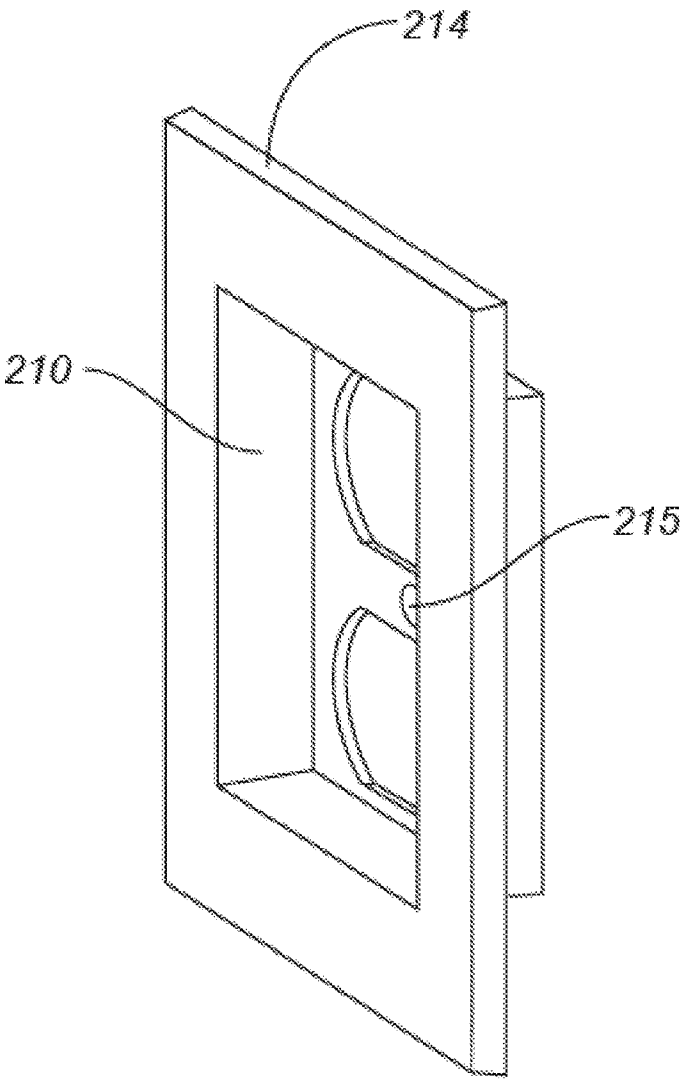
FIG. 16 illustrates a perspective view of the recessed receptacle plate of the embodiment illustrated in FIG. 13.

FIG. 16 illustrates an perspective view of the recessed receptacle plate 214. Functionally, the major distinction of this front plate from a standard front plate is the recessed section 210.

Figure 17:
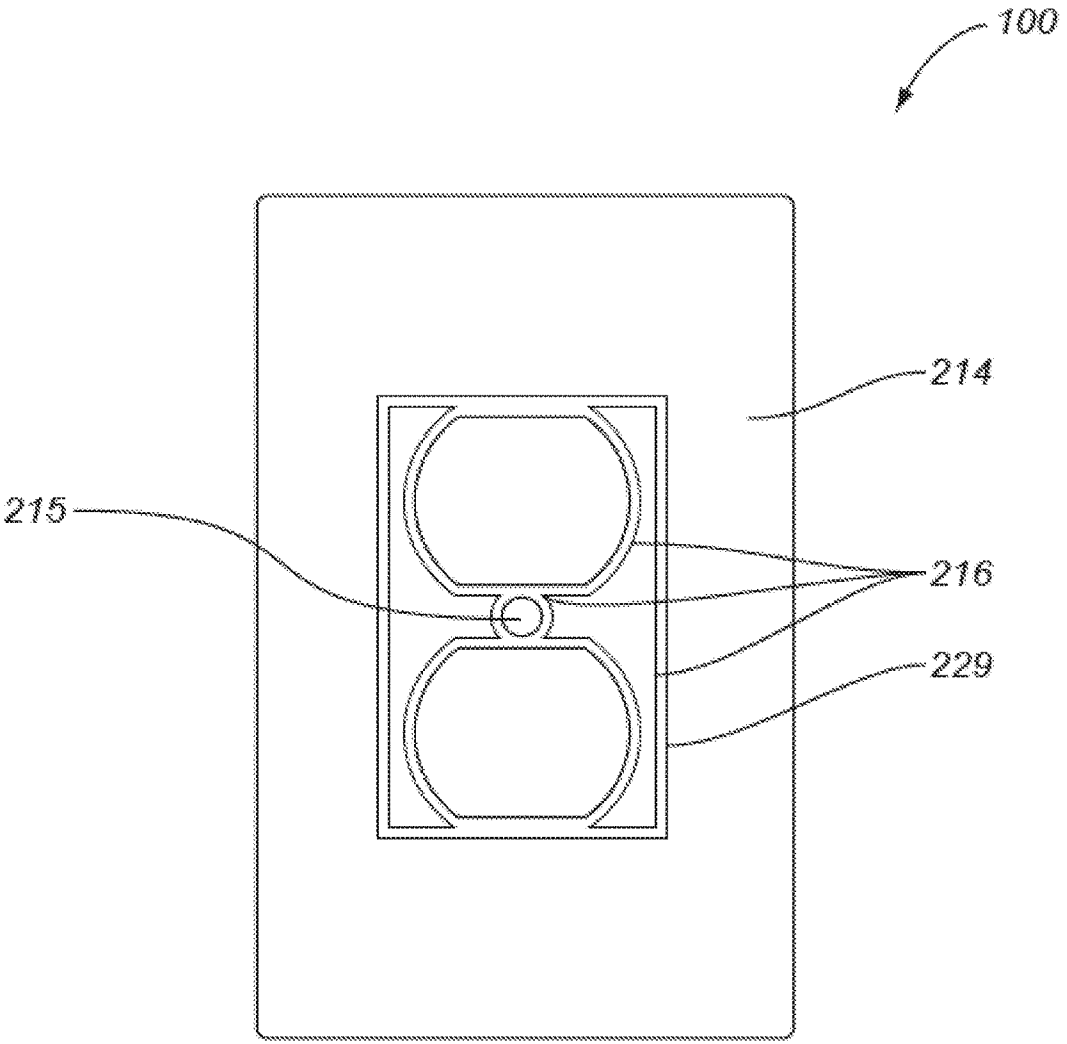
FIG. 17 illustrates a back view of the recessed receptacle plate of the embodiment illustrated in FIG. 13.

FIG. 17 illustrates a back view of the recessed receptacle plate 214. This view illustrates the inner recess 229 for fitting into the flange (not shown). The view also shows reinforcement walls 216 which provide structure to prevent cracking/breaking when screwed in place on the power receptacle 112 (not shown) via through hole 215.

DESCRIPTION OF EMBODIMENT—2-PART RECEPTACLE COVER PLATE ASSEMBLY WITH COMBINED RECEPTACLE PLATE AND SPOOL PLATE

Figure 23:
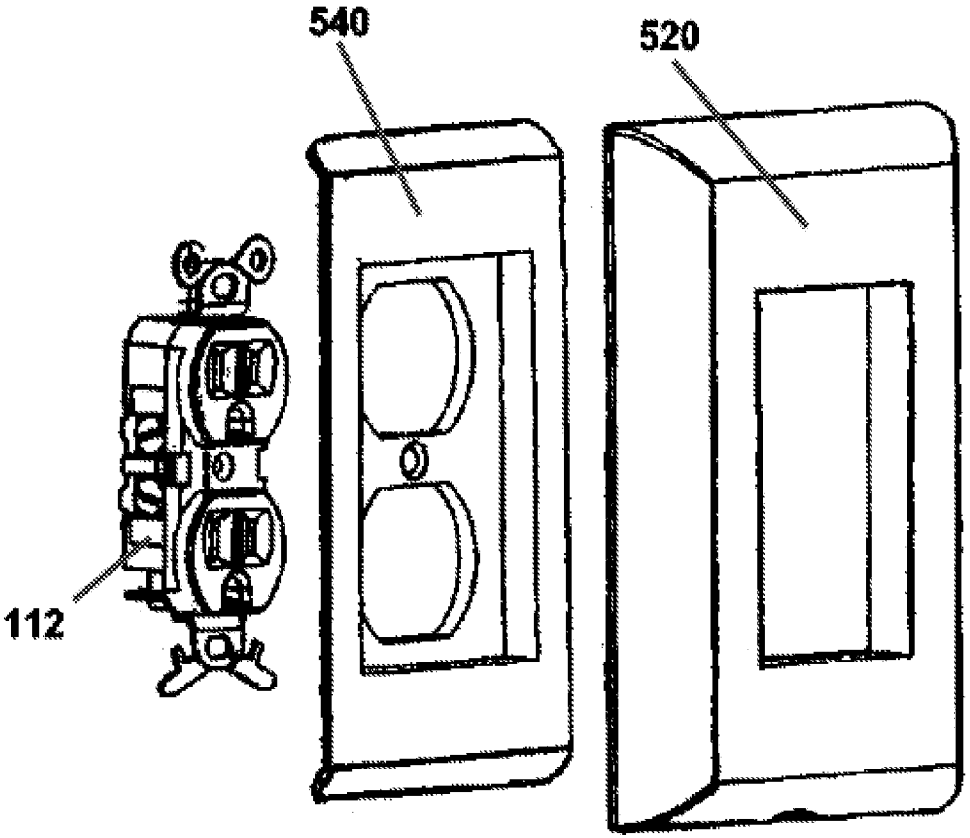
FIG. 23 is an exploded front perspective view of a two-part receptacle cover plate assembly with a combination plate which combines receptacle plate and spool plate.
Figure 24:
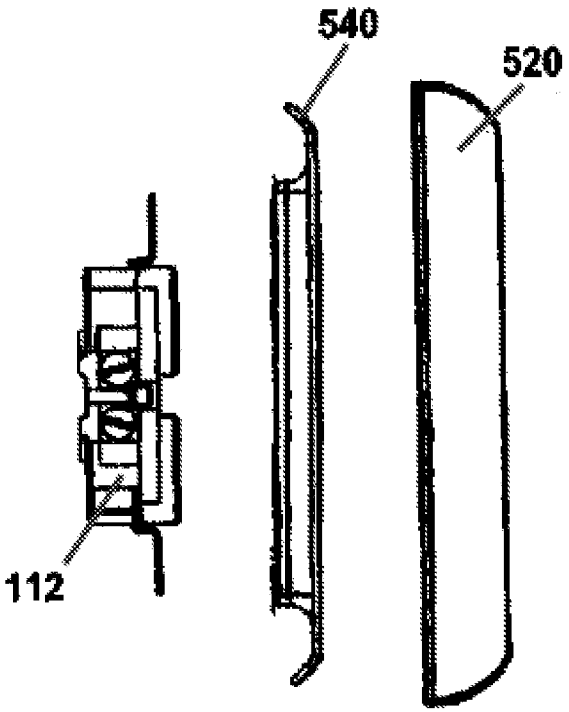
FIG. 24 is an exploded side view of the two-part device of FIG. 23.

FIG. 23 is an exploded front perspective view of a two-part device with a combination plate 540 which combines receptacle plate and spool plate, and a flange plate 520. FIG. 24 is an exploded side view of the two-part device of FIG. 23.

The following steps are executed to install this embodiment of a cover and an electrical receptacle in an empty receptacle box:

At step 1, install an electrical receptacle 112 onto electrical outlet box;

At step 2, install combination plate 540 onto receptacle 112 using a plate screw 7;

At step 3, begin winding cord 80 in-between wall and the combination plate 540, leaving a desired length of exposed cord out the bottom of combination plate 540;

At step 4, while placing flange plate 520 bottom opening 727 over cord 80 snap flange plate 520 onto combination plate 540;

At step 5, plug male cord end 82 into receptacle 112.

If an electrical receptacle is installed in the receptacle box, then step 1 may be omitted, the existing electric plate is removed and discarded, and steps 2-5 are executed.

DESCRIPTION OF EMBODIMENT—2-PART RECEPTACLE COVER PLATE ASSEMBLY WITH COMBINED RECEPTACLE PLATE AND SPOOL PLATE AND FLANGE PLATE WITH SECONDARY RECEPTACLE

Figures 25A, 25B:
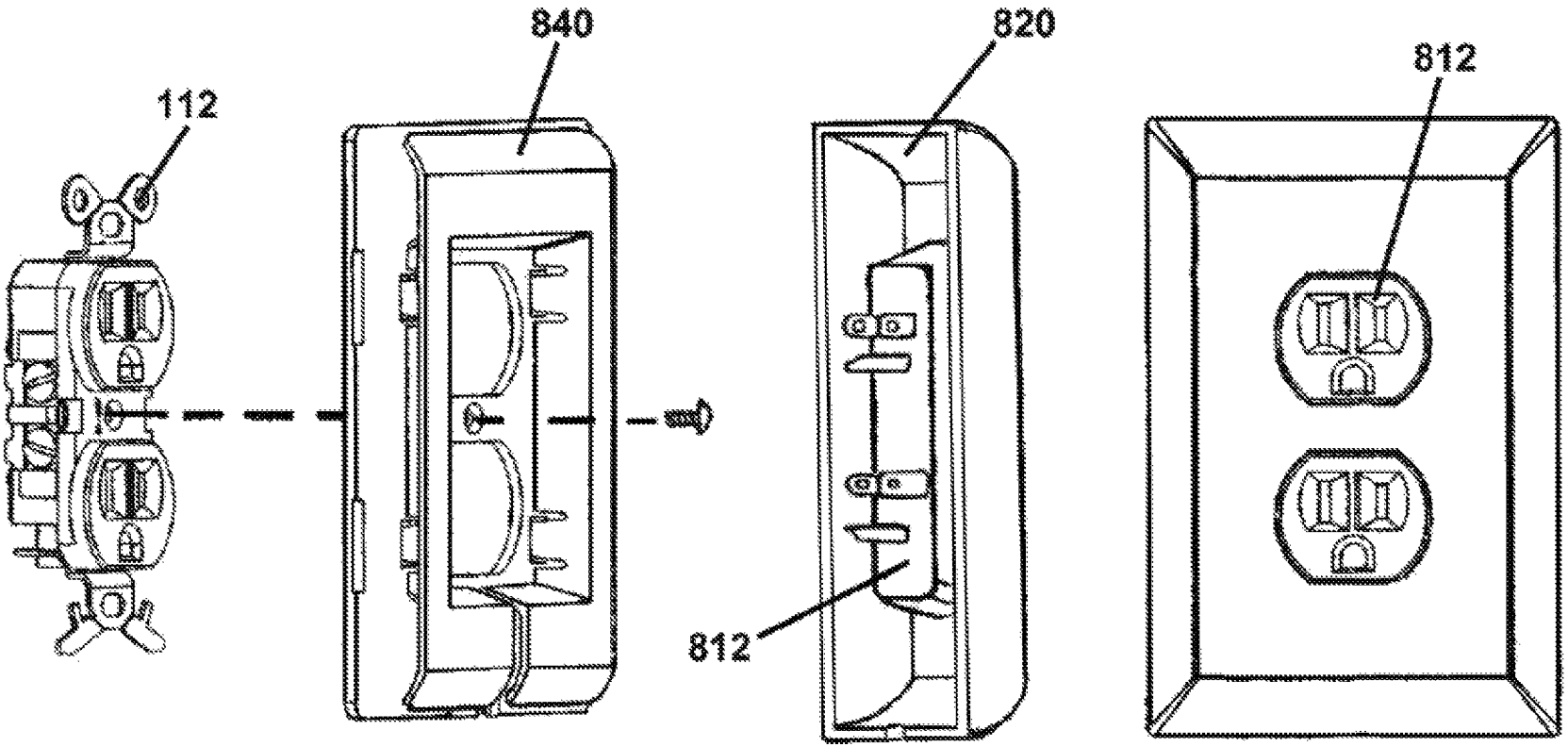
FIG. 25A is an exploded front perspective view of a two-part device with a combination plate which combines receptacle plate and spool plate, and a flange plate which includes a second receptacle.
FIG. 25B is a front view of the two-part device of FIG. 25A.

FIG. 25A is an exploded front perspective view of a two-part device with a combination plate 840 which combines receptacle plate and spool plate, and a flange plate 820 which includes a second receptacle 812. FIG. 25B is a front view of the two-part device of FIG. 25A.

The following steps are executed to install this embodiment of a cover and an electrical receptacle in an empty receptacle box:

At step 1, install an electrical receptacle 112 onto electrical outlet box;

At step 2, install combination plate 840 onto receptacle 112 using a plate screw 7;

At step 3, route cord 80 through bottom of combination plate 840 entering through entrance feature 119;

At step 4, begin winding cord around combination plate 840 into the space 746 provided;

At step 5, route the cord 80 and male cord end 82 through the entrance feature 119; leaving a desired length of exposed cord;

At step 6, plug second receptacle 812 combined with flange plate 820 into receptacle 112;

At step 7, plug male cord end 82 into second receptacle 812.

If an electrical receptacle is installed in the receptacle box, then step 1 may be omitted, the existing electric plate is removed and discarded, and steps 2-7 are executed.

DESCRIPTION OF EMBODIMENT—2-PART RECEPTACLE COVER PLATE ASSEMBLY WITH HINGED FLANGE PLATE

Figure 26A:
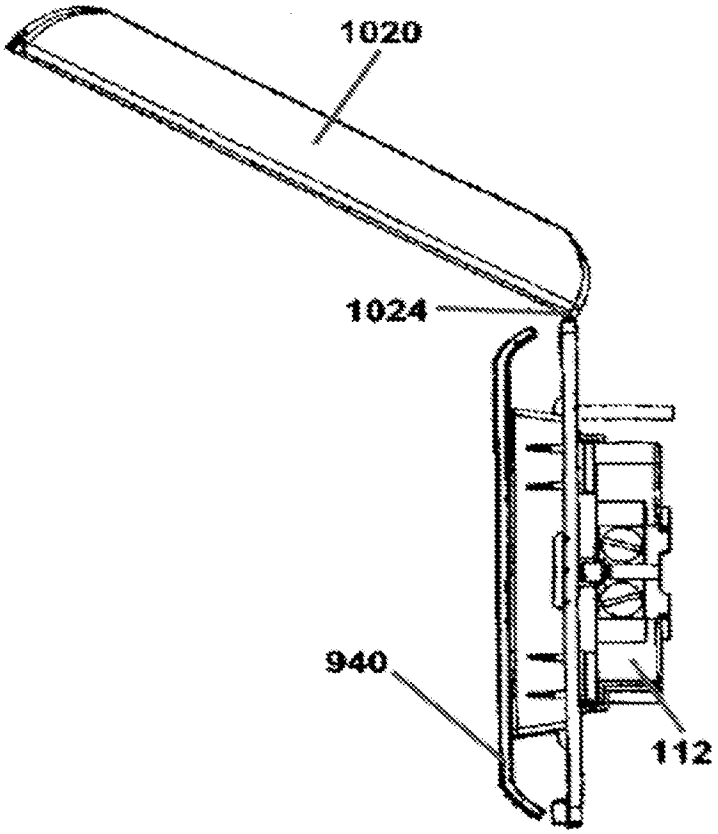
FIG. 26A is a side view of a two-part device with a combination plate which combines receptacle plate and spool plate, and a hinged flange plate with a top hinge.
Figure 26B:
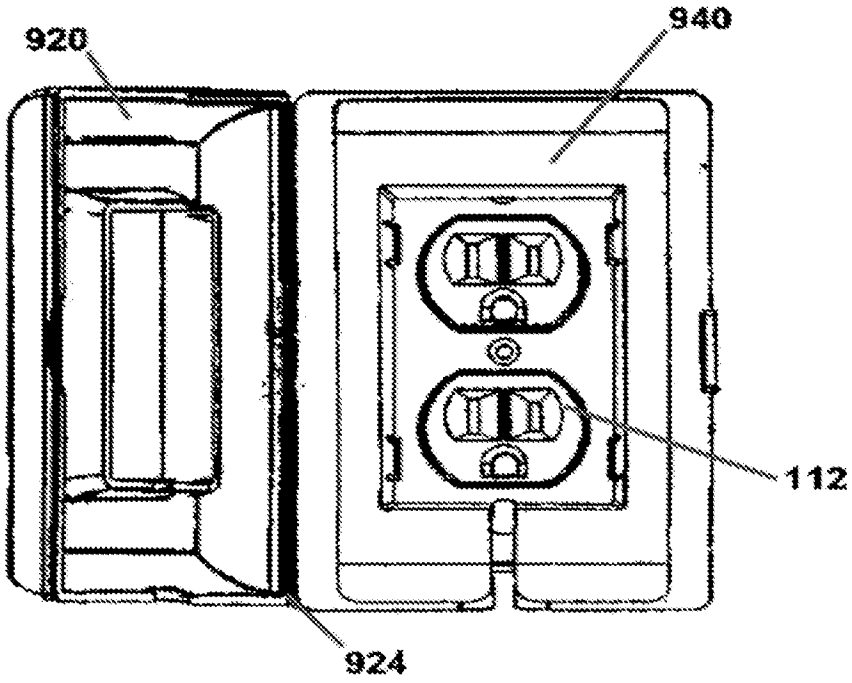
FIG. 26B is a front view of a two-part device with a combination plate which combines receptacle plate and spool plate, and a hinged flange plate with a side hinge.

FIG. 26A is a side view of a two-part device with a combination plate 940 which combines receptacle plate and spool plate, and a hinged flange plate 1020 with a top hinge 1024. FIG. 26B is a front view of a two-part device with a combination plate 940 which combines receptacle plate and spool plate, and a hinged flange plate 920 with a side hinge 924. In these examples, the hinged flange plate is opened to permit the wrapping of excess cord around the combination plate, and then the hinged flange plate is closed to conceal the wrapped cord.

The following steps are executed to install this embodiment of a cover and an electrical receptacle in an empty receptacle box:

At step 1, install an electrical receptacle 112 onto electrical outlet box;

At step 2, install combination plate 940 onto receptacle 112 using a plate screw 7;

At step 3, route cord 80 through bottom of combination plate 940 entering through entrance feature 119;

At step 4, begin winding cord around combination plate 940 into the space 746 provided;

At step 5, route the cord 80 and male cord end 82 through the entrance feature 119, leaving a desired length of exposed cord;

At step 6a, for FIG. 26A close flange plate 1020 by top hinge 1024 over combination plate 940 and snap together;

At step 6b, for FIG. 26B close flange plate 920 by side hinge 924 over combination plate 940 and snap together;

At step 7, plug male cord end 82 into receptacle 112.

If an electrical receptacle is installed in the receptacle box, then step 1 may be omitted, the existing electric plate is removed and discarded, and steps 2-7 are executed.

DESCRIPTION OF EMBODIMENT—2-PART RECEPTACLE COVER PLATE ASSEMBLY WITH COMBINED RECEPTACLE PLATE AND SPOOL PLATE AND RECESSED RECEPTACLE

Figures 27A, 27B, 27C:
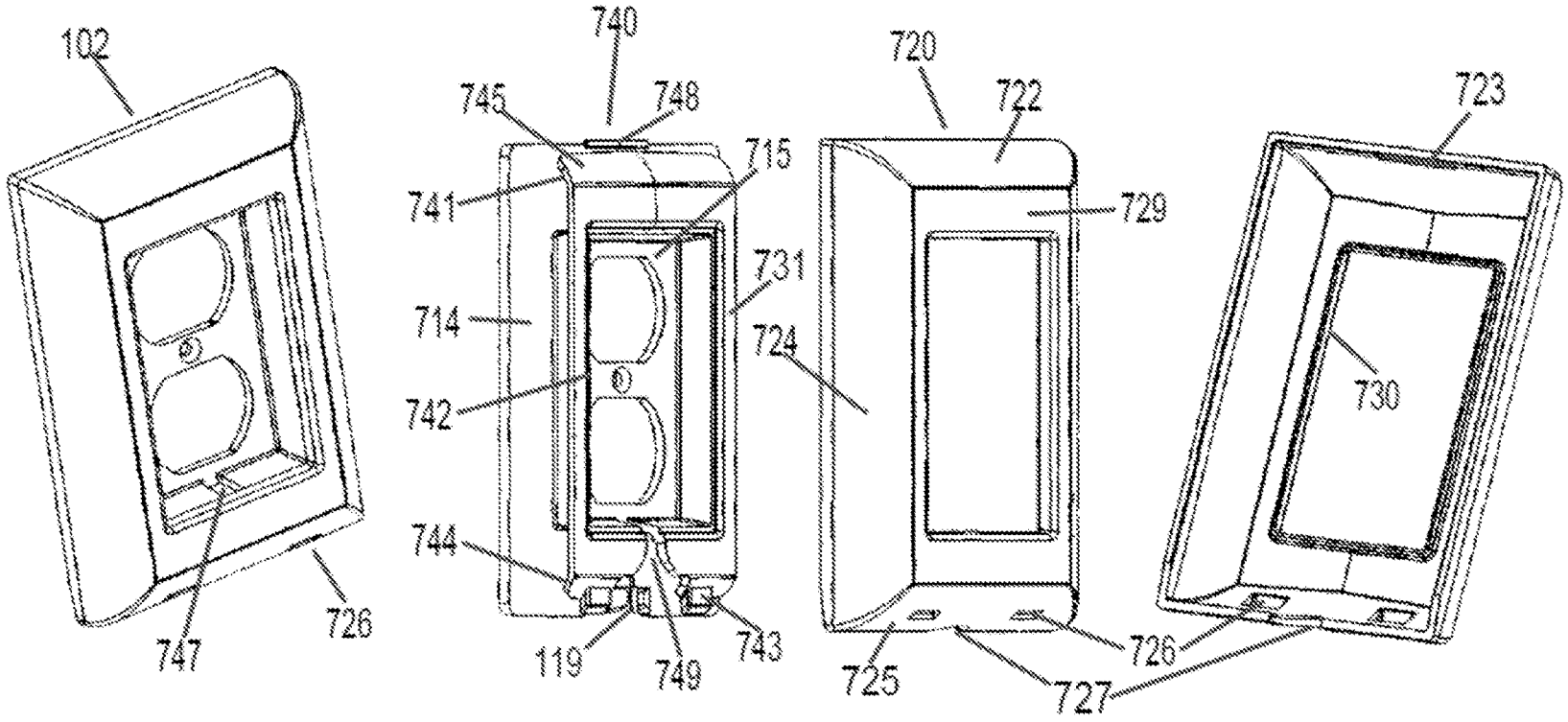
FIG. 27A is an exploded front perspective view of a two-part receptacle cover plate assembly with a combination plate which combines receptacle plate and spool plate.
FIG. 27B is rear perspective view of the two-part device of FIG. 27A.
FIG. 27C is front perspective view of the assembled two-part device of FIG. 27A.

FIG. 27A is an exploded front perspective view of a two-part device 102 with a combination receptacle cover plate and spool plate 740 which combines receptacle plate 714 and spool plate, and a flange plate 720. In this embodiment, the flange plate includes a rearward-extending rearward angular flanges projecting from the top, bottom, and sides of the front face. The rearward angular flanges include a top flange 722, side flanges 724, and a bottom flange 725. These flanges conceal the wrapped cord and provide a pleasant appearance for the device. The flange plate has a front face 729 also includes openings 726 to engage tabs 743 on the combination spool plate 740, and a bottom opening 727 for the cord. The combination spool plate 740 includes a split 749 to allow the cord to be inserted behind the spool cover 745, receptacle cover plate face 715, a spool cover recess 742, a planar middle portion 731, and spool cover tabs 743. The receptacle cover portion includes a cord entrance feature 119, and a cord opening 747 extends to the bottom of the recess window 742. The spool plate includes an inwardly curved upper portion 741 with a top snap feature 748, and an inwardly curved lower portion 744 with a pair of spool plate tabs 743 which are used to snap on the flange plate. The flange plate includes a pair of flange plate openings 726 on the bottom angular flange which are inserted over the pair of spool plate tabs.

FIG. 27B is rear perspective view of the two-part device 102 of FIG. 27A which shows a flange plate inset 723 for engaging the combination plate snap 748. FIG. 27B also shows a flange plate rib 730 to add strength to the flange plate and to fit into spool plate cover 745 inset 742.

FIG. 27C is front perspective view of the assembled two-part device 102 of FIG. 27A showing a cord entrance slot 747.

In this embodiment, the electric outlet is enclosed by the receptacle box (not shown) and the receptacle plate 714. The spool cover recess 742, also called "recessed window", serves to conceal the offset between the receptacle plate 714 and the spool cover 745, thereby concealing the wrapped cord and providing an attractive appearance for the cover device. The flange plate includes a flanged plate recess 730 which aligns with the spool cover recess 742 in order to conceal the gap between the spool cover 745 and the front face 729 of the flange plate.

In this embodiment, the spool cover recess 742 provides a "recessed window" where the spool plate is recessed for cord storage around the sides, top, bottom a spool plate mounted to an existing receptacle. The recessed window conceals the wrapped cord and provides a pleasant appearance.

Figure 29B:
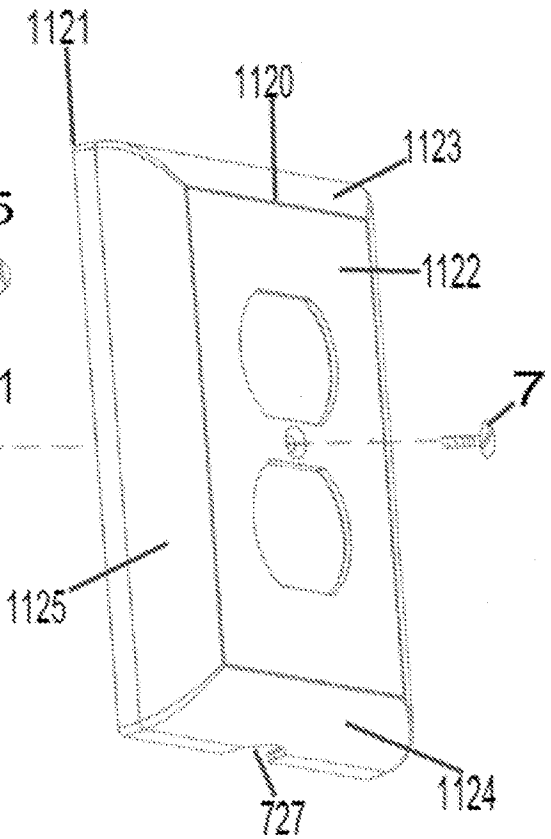
FIG. 29B is an exploded front perspective view of a two-part embodiment of FIG. 29A with a flush receptacle, a spool plate, and a combined flange plate and receptacle cover.
Figure 29B:
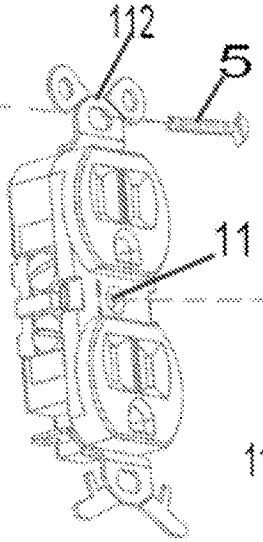
Figure 29A:
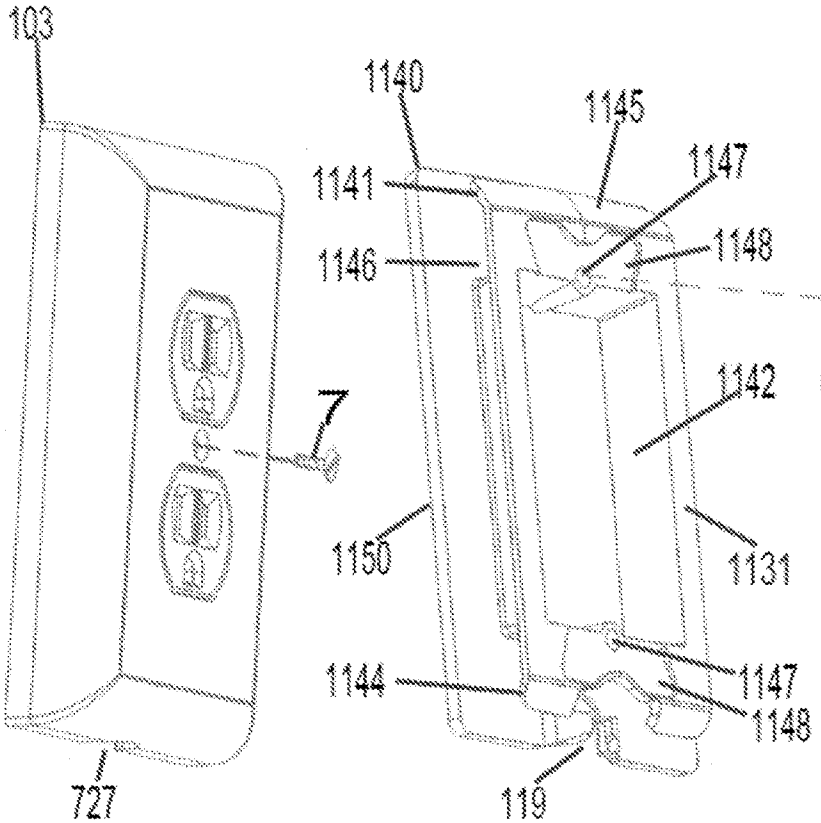
FIG. 29A is a front perspective view of an assembled two-part embodiment.
Figure 30:
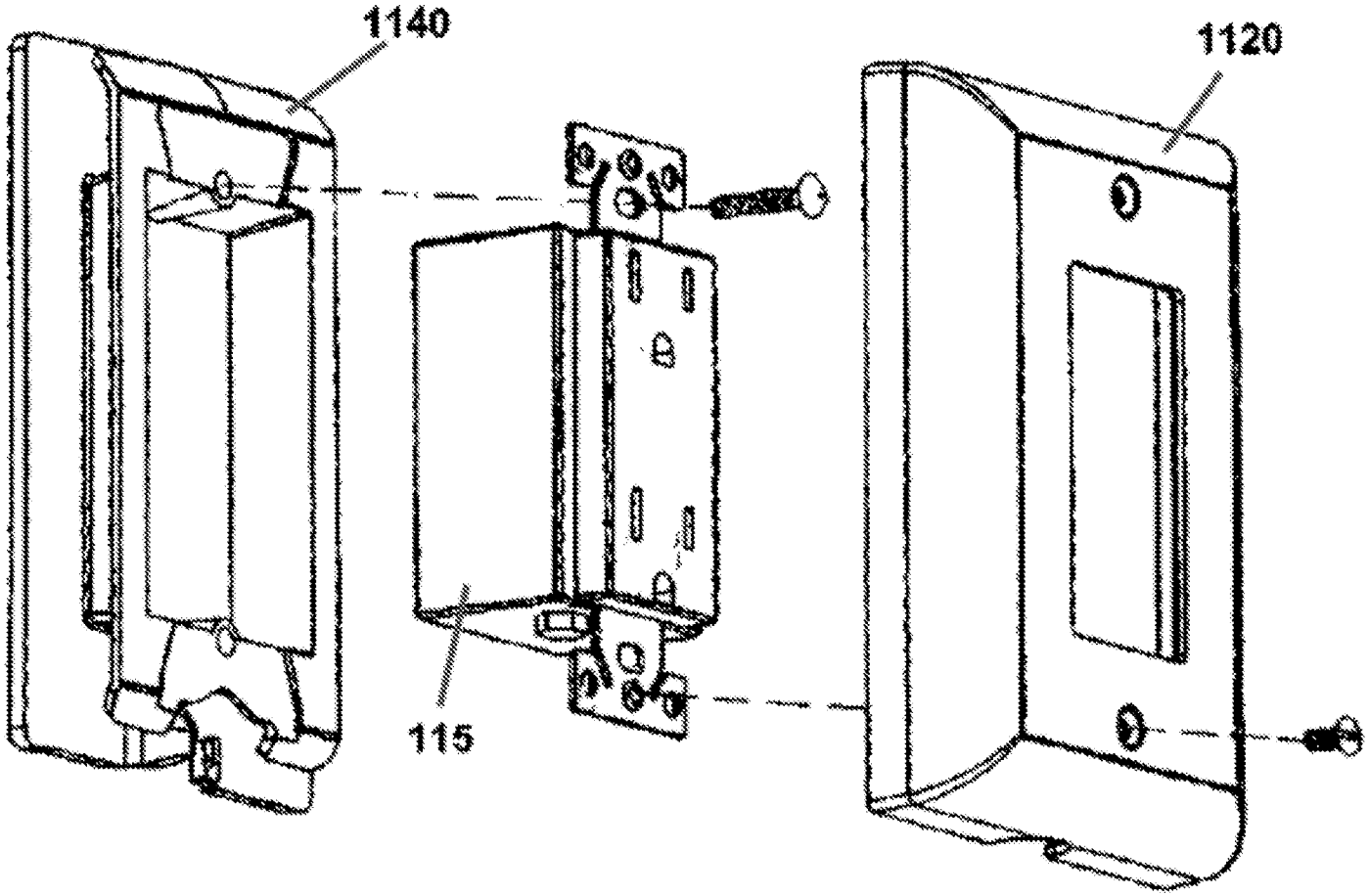
FIG. 30 is an exploded front perspective view of a two-part device with a flush ground fault receptacle, a spool plate, and a combined flange plate and receptacle cover.
Figure 31B:
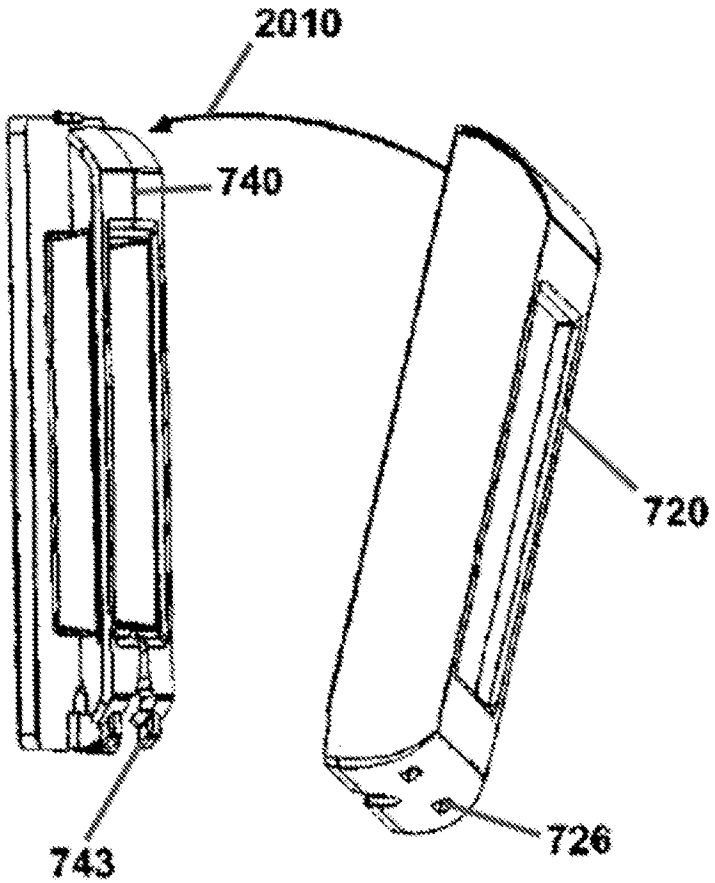
FIG. 31B is an exploded side view showing the attachment of the flange plate to the combination plate of FIG. 27A.
Figure 31A:
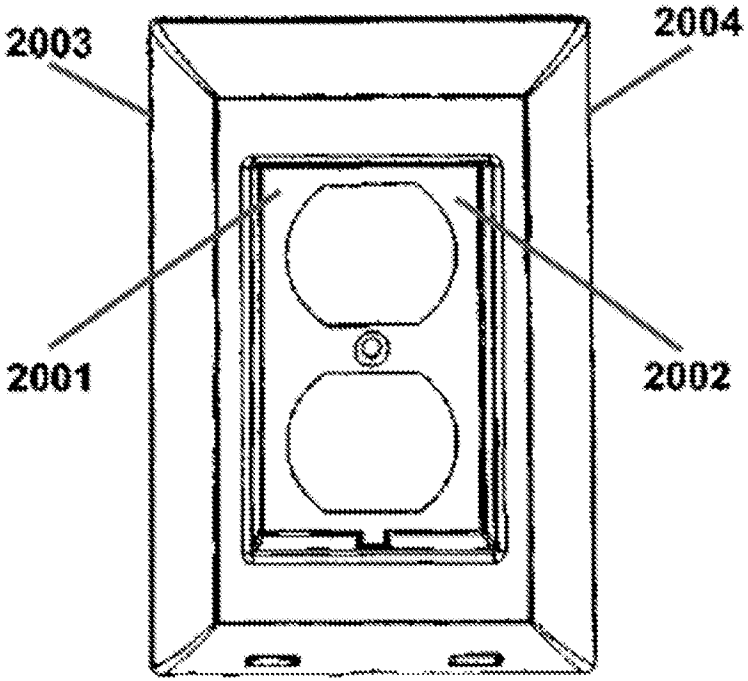
FIG. 31A is a front view showing the location of fingers and thumbs to remove the flange plate from the combination plate in FIG. 27A.

In other embodiments, where the receptacle is not recessed, and is mounted flush to the flange plate such as in FIGS. 29-30, an "open window" in the spool plate is used as a feed through for a receptacle and wires. In this case, the window serves as a receptacle box extension ring, as well as a portion of the spool plate for cord storage.

Figure 28D:
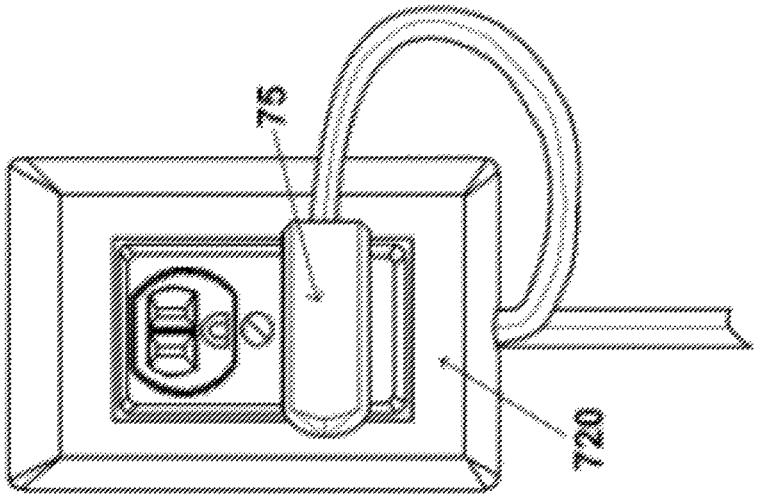
FIG. 28D is a front view of the flange plate installed over the combination plate of FIG. 28B, with an oversized charger plugged into the receptacle.
Figure 28C:
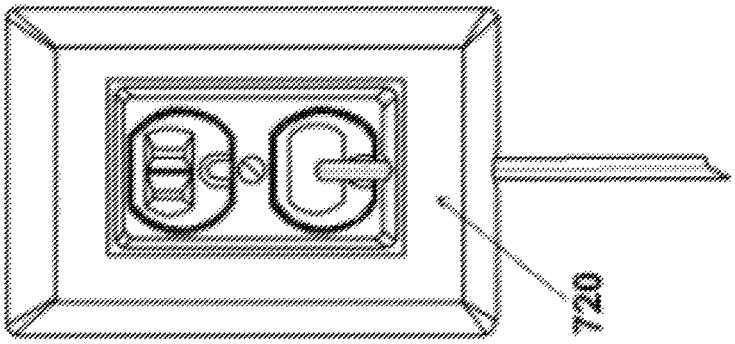
FIG. 28C is a front view of the flange plate installed over the combination plate of FIG. 28B.
Figure 28B:
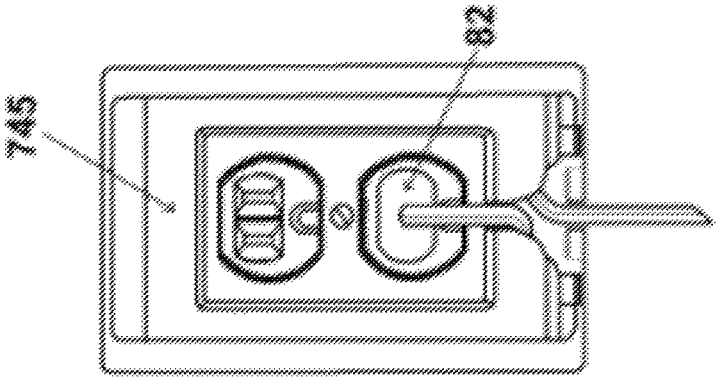
FIG. 28B is a front view of the combination plate of FIG. 28A installed over a receptacle, and a cord wrapped around the space behind the spool cover.
Figure 28A:
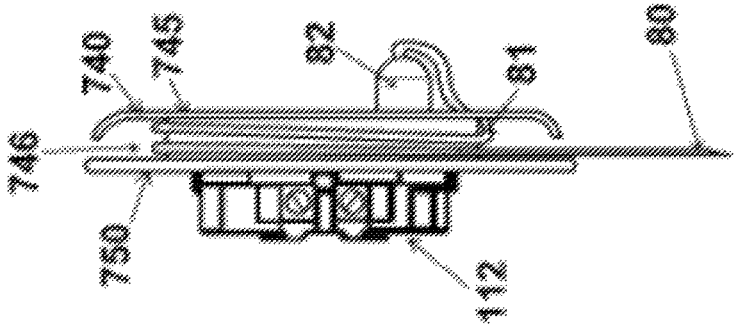
FIG. 28A is a side view of the embodiment of FIG. 27A-C showing the combination spool plate with and a portion of a cord wrapped in the space between the spool cover and the rear plate combination spool plate.

FIG. 28A is a side view of the embodiment of FIG. 27A-C showing the combination spool plate 740 with a space 746 created between the spool cover 745 and the rear plate 750, and a portion 81 of cord 80 wrapped in the space 746.

FIG. 28B is a front view of the combination plate 740 of FIG. 28A installed over receptacle 112, and a cord 80 wrapped around the space behind the spool cover 745. FIG. 28C is a front view of the flange plate 720 installed over the combination plate 740 of FIG. 28B. FIG. 28D is a front view of the flange plate 720 installed over the combination plate 740 of FIG. 28B, with an oversized charger 75 plugged into the receptacle.

FIG. 29A is a front view showing the location of fingers 2003 and 2004 and thumbs 2001 and 2002 to remove the flange plate from the combination plate in FIG. 27A. In this example, the thumbs are pressed against the receptacle plate portion of the combination plate, and the fingers are used to pry open the flange plate.

FIG. 29B is an exploded side view showing the attachment of the flange plate to the combination plate of FIG. 27A. In this example, the slots at the bottom the flange plate are inserted over the tabs at the bottom of the combination plate, and the top of the flange plate is rotated 2010 to engage the top portion of the combination plate.

The following steps are executed to install this embodiment of a cover and an electrical receptacle in an empty receptacle box:

At step 1, install an electrical receptacle 112 onto electrical outlet box;

At step 2, install combination plate 740 onto receptacle 112 using a plate screw 7;

At step 3, route cord 80 through the bottom of the combination plate 740 entering through the entrance feature 119;

At step 4, begin winding cord between rear plate 750 and spool cover 745 into the space 746 provided, leaving a desired length of exposed cord;

At step 5, route the male cord end 82 through the bottom opening 727 and plug into receptacle 112;

At step 6, install flange plate 720 by inserting combination plate 740 engage tabs 743 into flange plate 720 openings 726 slots, and then press flange plate 720 onto combination plate

740 by snapping the combination plate snap 748 into flange plate inset 723.

If an electrical receptacle is installed in the receptacle box, then step 1 may be omitted, the existing electric plate is removed and discarded, and steps 2-6 are executed.

DESCRIPTION OF EMBODIMENT—2-PART RECEPTACLE COVER PLATE ASSEMBLY WITH COMBINED RECEPTACLE PLATE AND SPOOL PLATE AND FLUSH RECEPTACLE

FIG. 29A is front perspective view of the assembled two-part device 103 showing a cord entrance slot 727 a plate screw 7.

FIG. 29B is an exploded front perspective view of the two-part device of FIG. 29A with a flush receptacle 112, a spool plate 1140, and a combined flange plate and receptacle cover 1120 comprising flange plate 1121 and receptacle cover 1122. The combined receptacle cover plate and flange plate 1120 includes a receptacle cover plate face 1122 covering a portion of the plug receptacle, and rearward angular flanges projecting from the top 1123, bottom 1124, and sides 1125 of the front face in order to conceal the spool plate. A plate screw 7 is used to attach the combined receptacle cover plate and flange plate 1121 to receptacle 112.

The rear plate 1150 includes a cord entrance slot 119, and the flange plate includes a cord opening 727 in the bottom angular flange. In this example, the receptacle cover plate and flange plate mounts to the receptacle 112 at threaded housing 11 with a plate mounting screw 7.

In this embodiment, the spool plate 1140 includes a space 1146 between a front spool cover 1145 and a rear plate 1150, and a framed window 1142. In this embodiment, the flange plate and receptacle provide a flush appearance. The spool plate has a front face 1145 with a pair of screw holes 1147 to attach the plug receptacle.

In this embodiment, the framed window is concealed in the assembled device. The framed window provides an extended housing extension from the receptacle box. The electric outlet is protected by the receptacle box and the framed window, and the outlet 112 is enclosed by the receptacle box (not shown), spool plate framed window 1142, and receptacle cover 1122.

FIG. 30 is an exploded front perspective view of a two-part device with a flush ground fault receptacle 115 or a Decor receptacle, a spool plate 1140, and a combined 1121 flange plate and receptacle cover.

The following steps are executed to install this embodiment of a cover and an electrical receptacle in an empty receptacle box:

At step 1, install an electrical receptacle 112 onto electrical outlet box;

At step 2, feed receptacle 112 through the spool plate 1140 framed window 1142;

At step 3, remount receptacle 112 onto the front of the spool plate 1140 using receptacle mounting screws 5. Screws pass through receptacle mounting holes 118 through Spool Plate

1140 screw hole 1147 then into electrical outlet box;

At step 4, route cord 80 through bottom of spool plate 1140 entering through entrance feature

119;

At step 5, begin winding cord between rear plate 1150 and front spool cover 1145 into the space 1146 provided;

At step 6, route the end of the cord 80 back through bottom of spool plate 1140 through entrance feature 119, leaving a desired length of exposed cord;

At step 7, install combined flange plate and receptacle cover 1120 using plate screw 7;

At step 8, plug male cord end 82 into receptacle 112.

If an electrical receptacle is installed in the receptacle box, then step 1 may be omitted, the existing electric plate is removed and discarded, and steps 2-8 are executed.

DESCRIPTION OF EMBODIMENT—3-PART RECEPTACLE COVER PLATE ASSEMBLY WITH FLUSH RECEPTACLE

Figure 32:
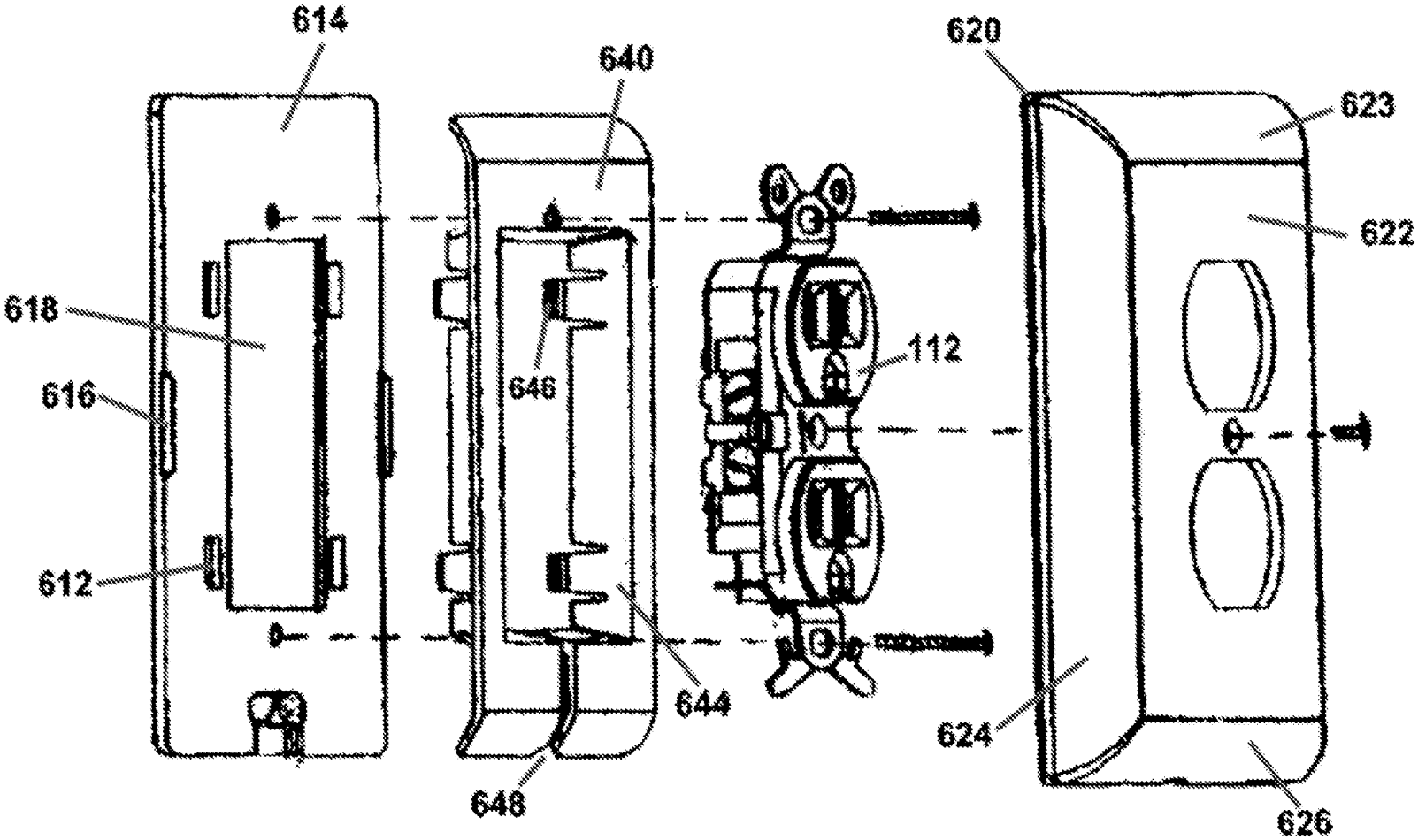
FIG. 32 is an exploded front perspective view of a three-part device with a flush receptacle, a back plate, spool plate, and flange plate, with snap features.

FIG. 32 is an exploded front perspective view of a three-part device with a flush receptacle 112, a back plate 614, spool plate 640, and flange plate 620, with snap features. In this example, snap features include tabs 646 on the spool palate which engage slots 612 on the rear plate, and tabs 616 on the rear plate which engage a portion of the side flanges 624 of the flange plate. The rear plate includes an opening 618 for the rear portion of the receptacle. The spool plate includes a framed window 644 for the receptacle, and a slot 648 for the cord. The flange plate 620 includes a top flange 623, a bottom flange 626, side flanges 624, and a receptacle cover 622.

DESCRIPTION OF EMBODIMENT—3-PART RECEPTACLE COVER PLATE ASSEMBLY WITH RECESSED RECEPTACLE

Figure 33:
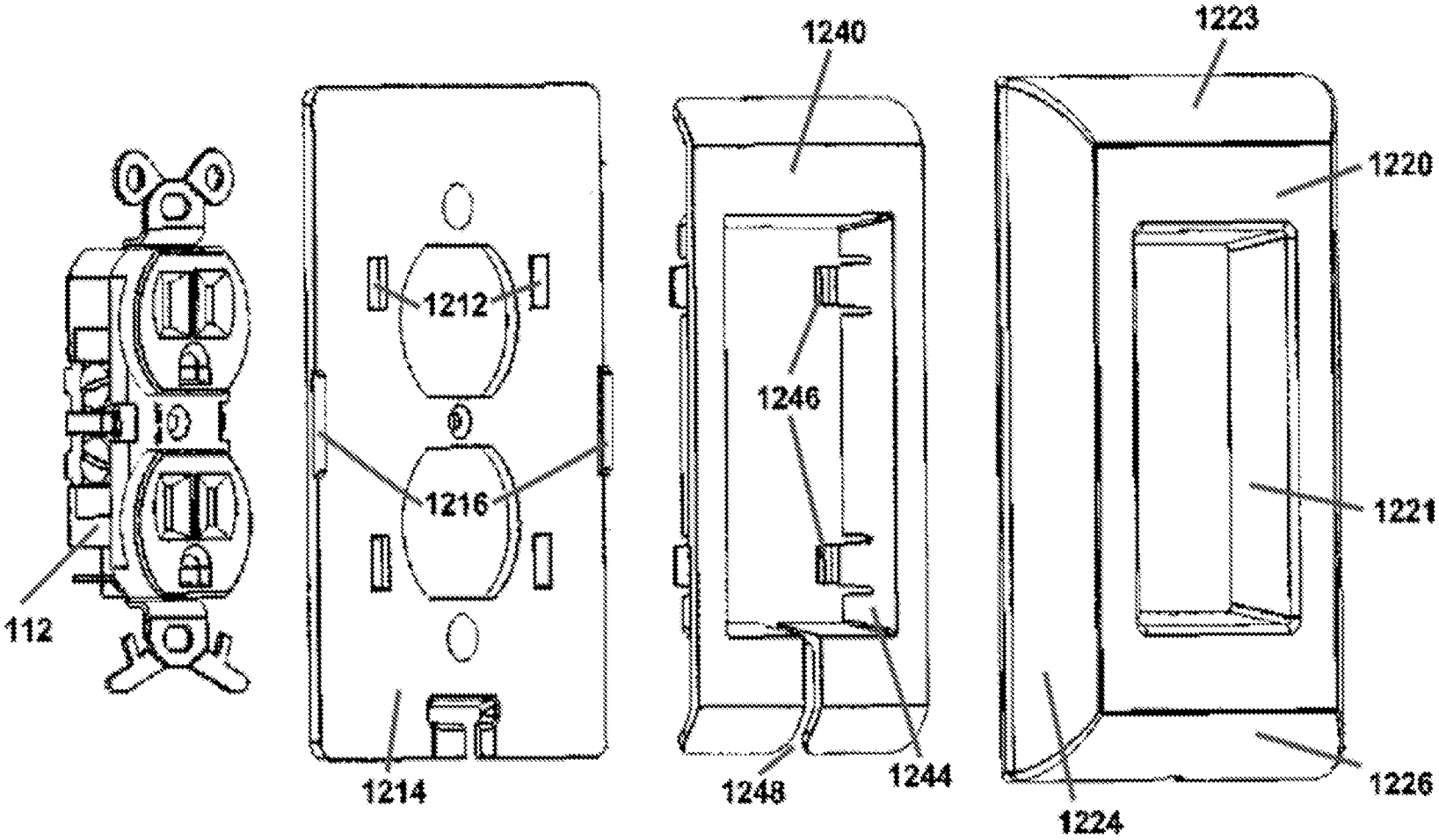
FIG. 33 is an exploded front perspective view of a three-part device with a recessed receptacle, a receptacle plate, spool plate, and flange plate, with snap features.

FIG. 33 is an exploded front perspective view of a three-part device with a recessed receptacle 112, a receptacle plate 1214, spool plate 1240, and a flange plate 1220, with snap features.

In this example, snap features include tabs 1246 on the spool palate which engage slots 1212 on the receptacle plate, and tabs 1216 on the receptacle plate which engage a portion of the side flanges 1224 of the flange plate. In this example, the spool plate includes an inwardly curved upper portion 1141 and an inwardly curved lower portion 1144, and a planar middle portion 1131 which houses the receptacle 112 at indentions 1148. The spool plate includes a framed window 1244 for the receptacle, and a slot 1248 for the cord. The flange plate 1220 includes a top flange 1223, a bottom flange 1226, side flanges 1224, and a framed window 1221.

Figure 34:
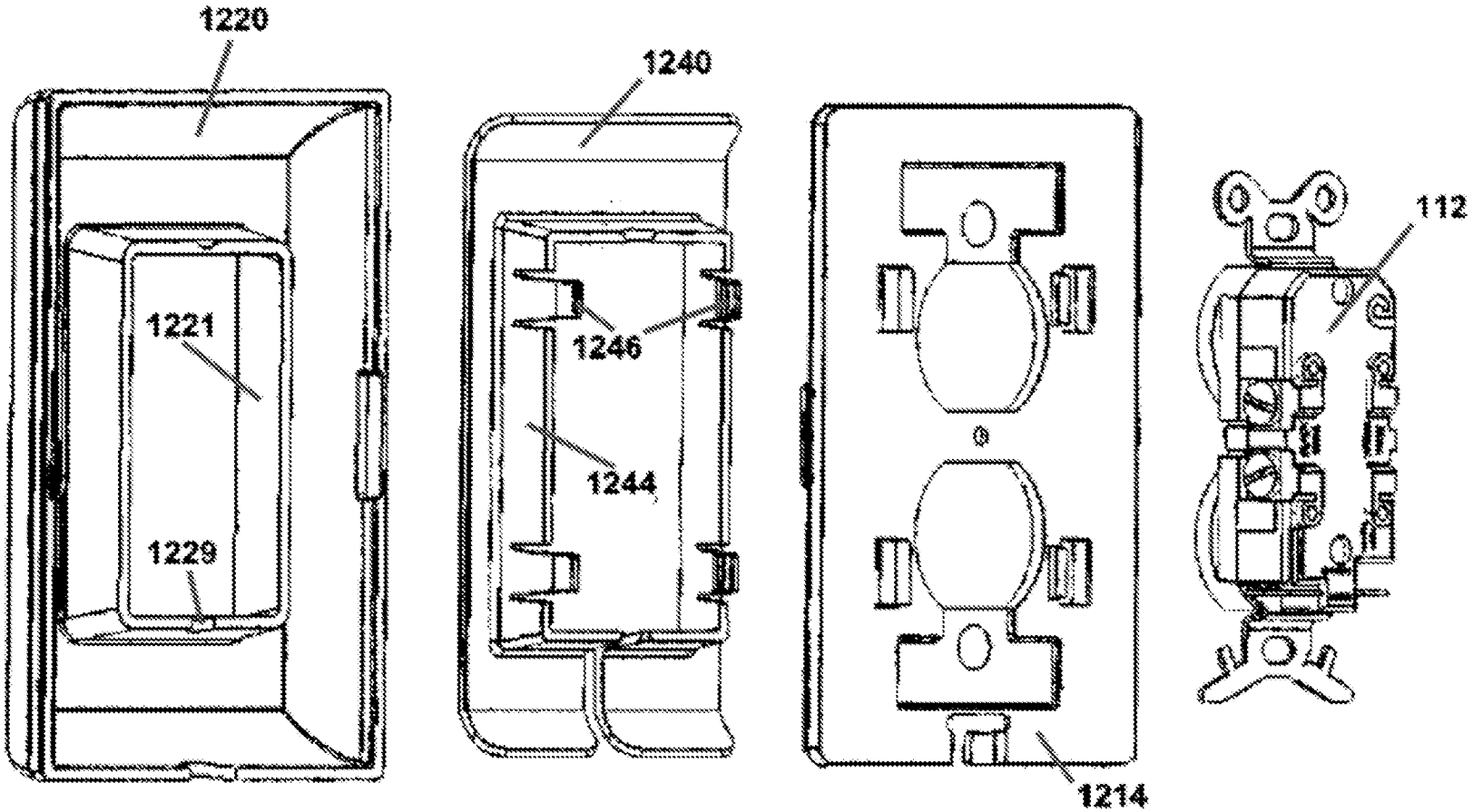
FIG. 34 is an exploded rear perspective view of the embodiment of FIG. 33.

FIG. 34 is an exploded rear perspective view of the embodiment of FIG. 33 showing the flange plate 1220, spool plate 1240, and receptacle plate 1214.

Figure 35B:
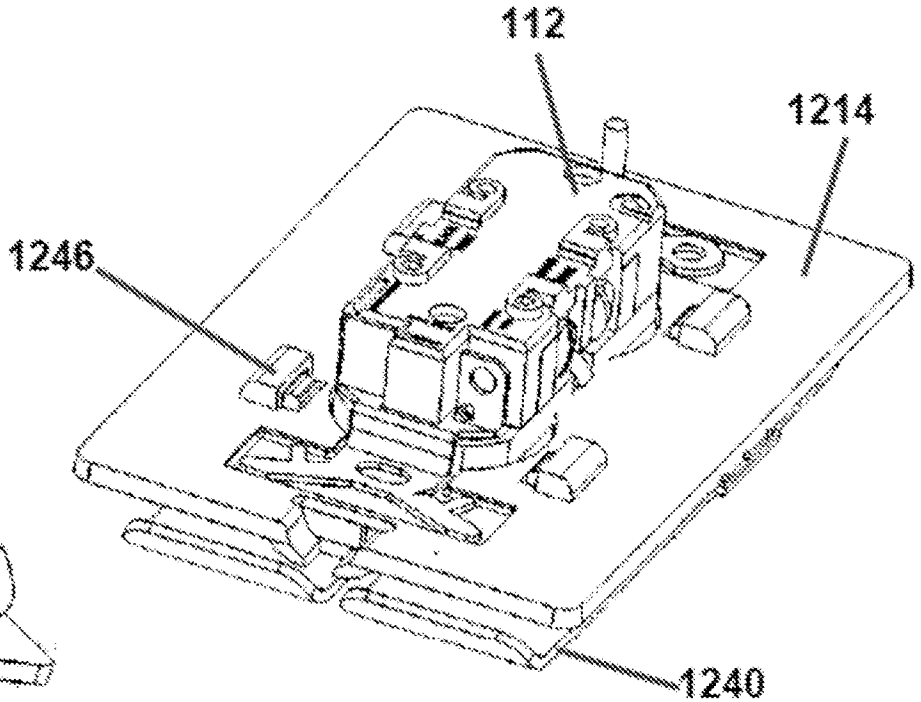
FIG. 35B is a rear perspective view of the embodiment of FIG. 35A.
Figure 35A:
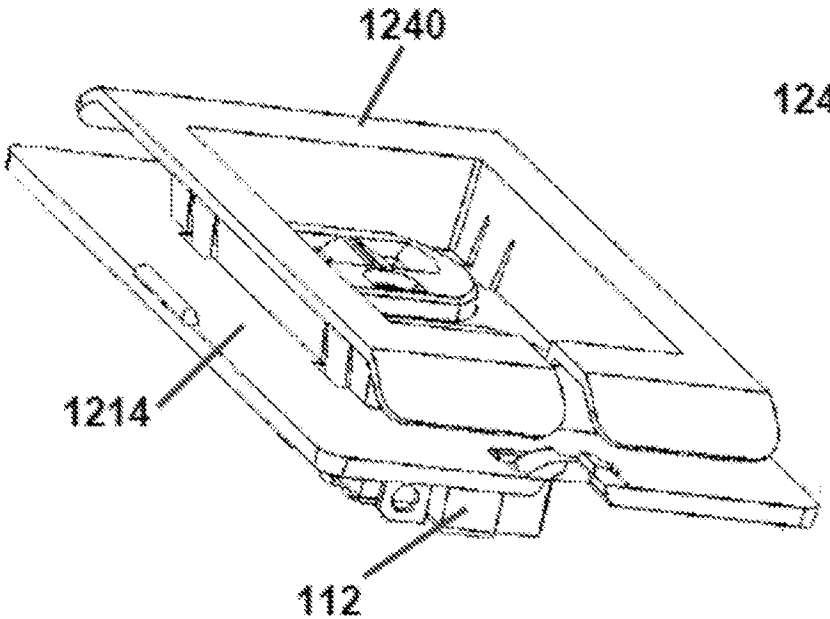
FIG. 35A is a front perspective view of a recessed receptacle embodiment.

FIG. 35A is a front perspective view and FIG. 35B is a rear perspective view of a recessed receptacle embodiment.

DESCRIPTION OF EMBODIMENT—2-PART RECEPTACLE COVER PLATE ASSEMBLY WITH COMBINED RECEPTACLE PLATE AND SPOOL PLATE AND FLUSH RECEPTACLE AND USB PORTS

FIGS. 40-43 show several examples of cover plate assemblies with one or more receptacle and one or more USB port.

Example—Example Cover Plates

Figure 40A:
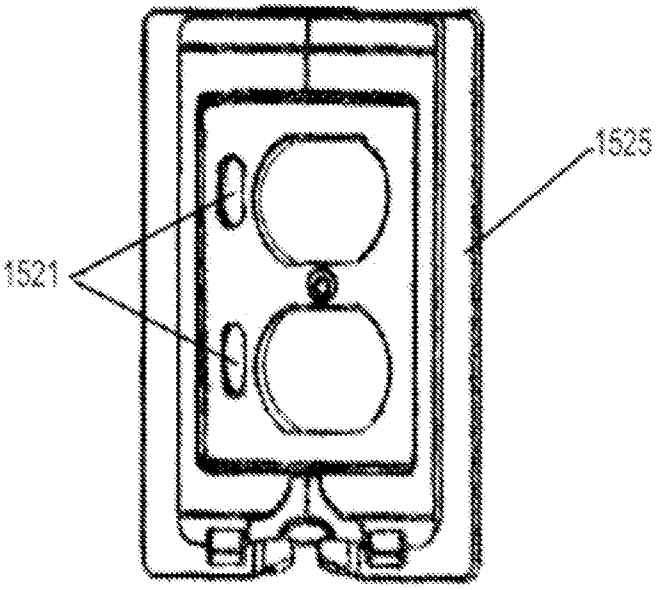
FIG. 40A is a front view of a receptacle cover plate assembly for a plug with two USB slots.
Figure 40B:
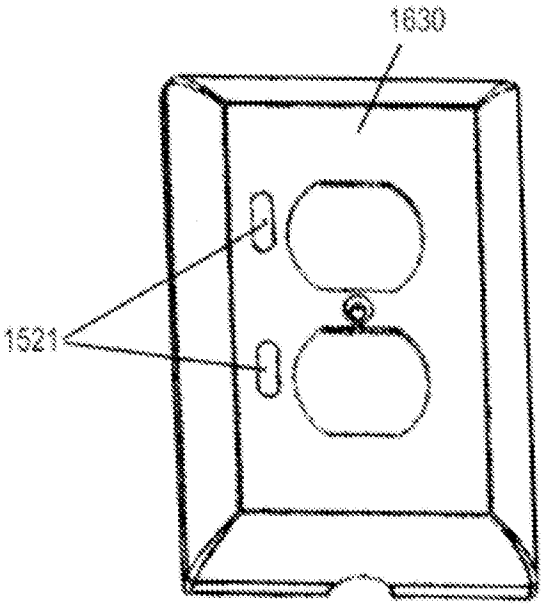
FIG. 40B is a front view of a flush outlet cover plate with USB slots in the cover plate for the assembly receptacle cover plate assembly of FIG. 40A
Figure 40C:
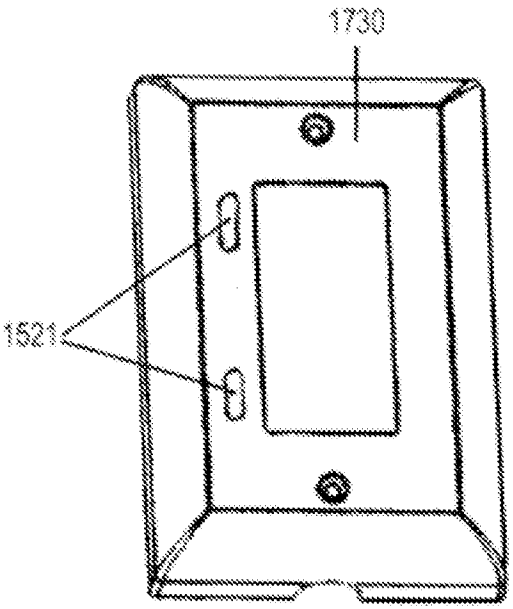
FIG. 40C is a front view of a GFCI/Decor outlet cover plate with USB slots in the cover plate for the assembly receptacle cover plate assembly of FIG. 40A.

FIGS. 40A-40C show USB ports in combination with electrical outlets for example plate covers.

FIG. 40A is a front view of a recessed receptacle cover plate assembly for a plug with two USB slots. In this example, the combination spool/outlet plate 1525 has two USB slots 1521 in the cover.

FIG. 40B is a front view of a flush outlet cover plate, which fits the spool plate 1140 of FIG. 29 and FIG. 30. In this figure the flush outlet cover plate 1630 has two USB slots 1521 in the cover. FIG. 40 C is a front view of a GFCI/Decor outlet cover plate which fits the spool plate 1140 of FIG. 29 and FIG. 30. In this figure the GFCI/Decor outlet cover plate 1730 has two USB slots 1521 in the cover.

Example—"All-in-One" Duplex Outlet with USB Side Ports

FIGS. 41A-41C and 42A-42C show receptacles which are built-into the spool plates to provide one piece units. Both a regular outlet and a GFCI outlet are shown. In these examples, a DC charger is piggy-backed to the receptacles in order to permit the USB ports to charge low voltage devices.

Figures 41A, 41B, 41C:
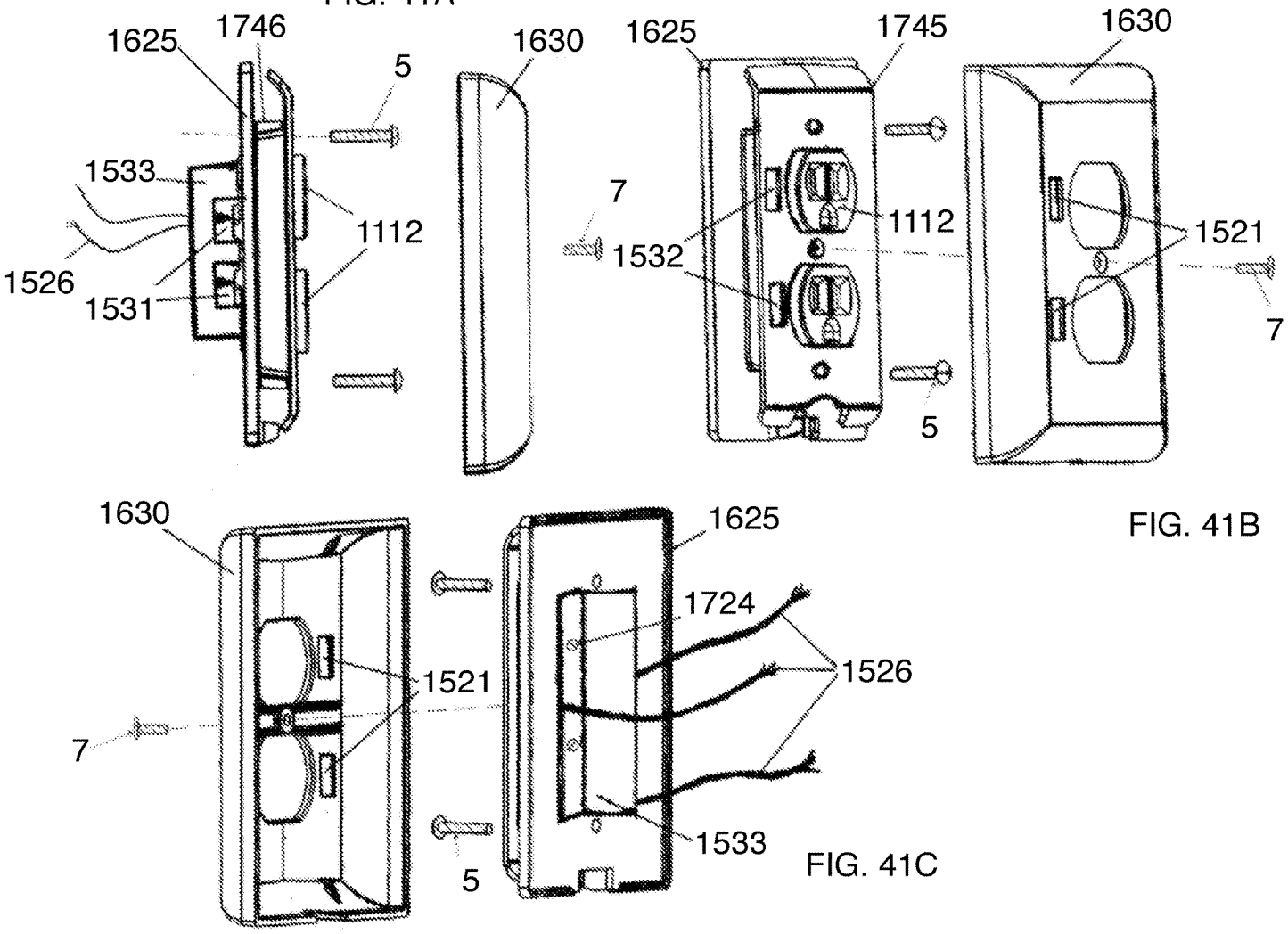
FIG. 41B is an exploded side perspective view of a combination spool/outlet plate and flush outlet cover plate of FIG. 41A.
FIG. 41C is an exploded rear perspective view of a combination spool/outlet plate and flush outlet cover plate of FIG. 41A.

FIG. 41A is an exploded side view of a combination spool/outlet plate 1625 and a flush outlet cover plate with two USB slots in the cover and a DC charger 1533 attached or piggybacked to the backside of the receptacle 1112 to provide a one-piece or "all-inclusive" unit. This figure shows the side of a combination spool/outlet plate 1625 where the receptacle 1112 is built-in to the combination spool/outlet plate 1625 making it all-in-one piece or all inclusive. The combination spool/outlet plate 1625 has a DC charger 1533 attached or piggybacked to the backside of the receptacle 1112. The DC charger 1533 has two USB hubs 1531 on the side providing two USB ports 1532.

In this example, the DC charger 1533 supplies two USB hubs 1531 on the side of the outlet receptacle, thereby providing two USB ports 1532 which are accessible through flush outlet cover plate 1630.

FIG. 41B is an exploded side perspective view of a combination spool/outlet plate and flush outlet cover plate of FIG. 41A. This figure shows the combination spool/outlet plate 1625 where the receptacle 1112 is built-in to the combination spool/outlet plate 1625 making it all-in-one piece or all inclusive to provide the two USB ports 1532 and the Flush outlet cover plate 1630 that has two USB slots 1521 in the cover.

FIG. 41C is an exploded rear perspective view of a combination spool/outlet plate 1625 and flush outlet cover plate 1630 of FIG. 41A. This figure shows the backside of the combination spool/outlet plate 1625 with the DC charger 1533 is attached or piggybacked to the backside of the receptacle 1112. The figure also shows the outlet 1112 terminal wires 1526. These wires connect by splicing with the circuit wires providing 110 volts supply to both the receptacle 1112 and the DC charger 1533. AC power supply can be attached to terminal screws 1724, or by terminal wires 1526. In other examples, the terminal wires 1526 may be connected to either the receptacle 1112 or the DC charger 1533.

FIGS. 41A-41C show the DC charger 1533 attached or piggybacked to the backside of the receptacle 1112. One feature of having the receptacle built into the spool plate is to move the receptacle out of the electrical box so that there is more room in the electrical box for the DC charger 1533 to fit along with the circuit wires that fill up an electrical box.

Another feature is that the device permits wrapping of excess cord from USB devices.

Example—"All-in-One" GFCI/Decor Outlet with USB Side Ports

Figure 42B:
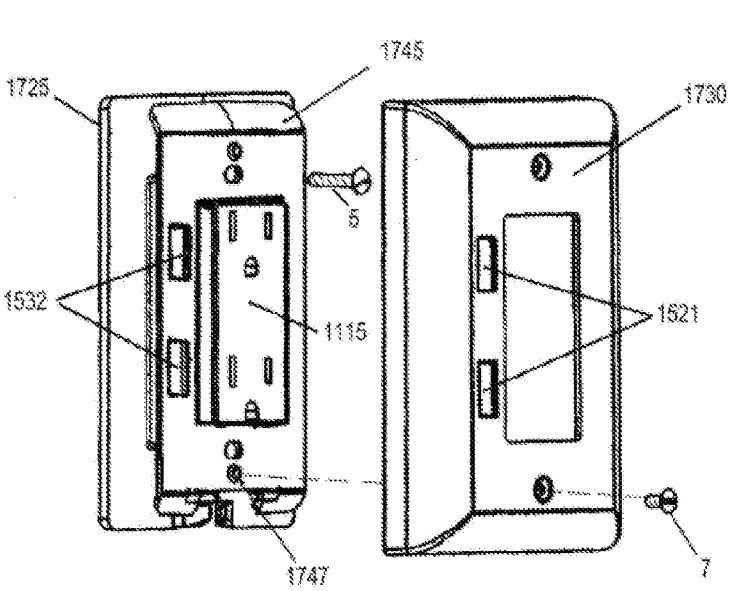
FIG. 42B is an exploded side perspective view of a combination spool/outlet plate and flush outlet cover plate of FIG. 42A.
Figure 42C:
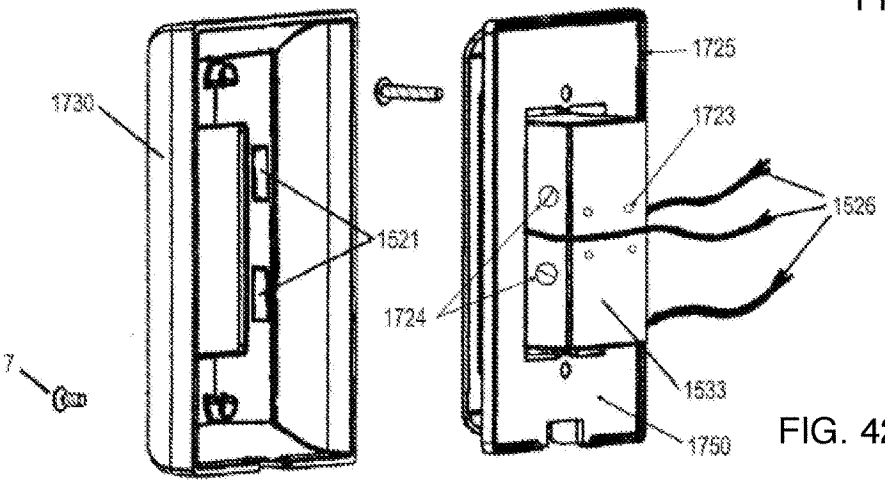
FIG. 42C is an exploded rear perspective view of a combination spool/outlet plate and flush outlet cover plate of FIG. 42A.
Figure 42A:
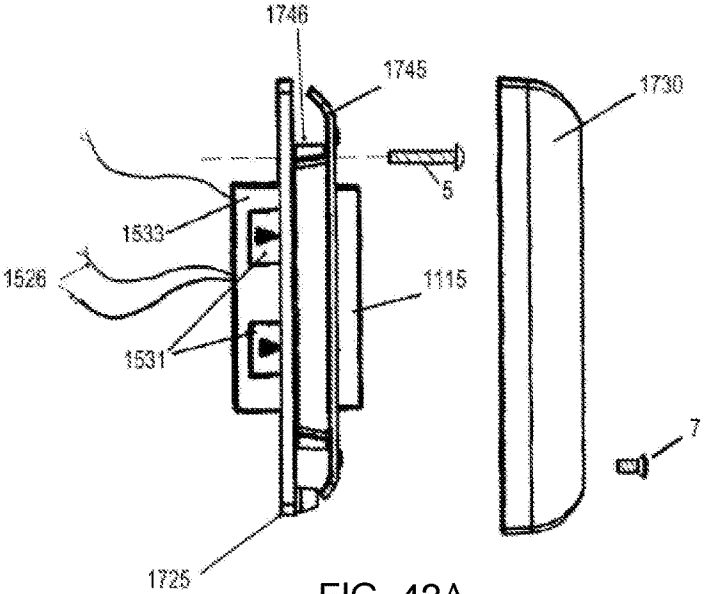
FIG. 42A is an exploded side view of a combination spool/outlet GFCI or Decor plate and an outlet cover plate with two USB slots in the cover and a DC charger attached or piggybacked to the backside of the receptacle.

FIG. 42A shows the side of combination spool/outlet plate 1725 where the receptacle 1115 is built-in to the combination spool/outlet plate 1725 making it all-in-one piece or all inclusive. The combination spool/outlet plate 1725 has a DC charger 1533 attached or piggybacked to the backside of the receptacle 1115. The DC charger 1533 has two USB hubs 1531 on the side providing two USB ports 1532 which are accessible through flush outlet cover plate 1730.

FIG. 42 B is an exploded side perspective view of a combination spool/outlet plate and flush outlet cover plate of FIG. 42 A. This figure shows the combination spool/outlet plate 1725 where the GFCI/Decor receptacle 1115 is built-in to the combination spool/outlet plate 1725 making it all-in-one piece or all inclusive providing the two USB ports 1532 and the GFCI/Decor outlet cover plate 1730 that has two USB slots 1521 in the cover.

FIG. 42 C is an exploded rear perspective view of a combination spool/outlet plate 1725 which shows the DC charger 1533 attached or piggybacked to the backside of the receptacle 1115. Also in this figure it shows the outlet 1115 terminal wires 1526. These wires connect by splicing with the circuit wires providing 110 volts supply to both the receptacle 1115 and the DC charger 1533. AC power supply can be attached to terminal screws 1724, or by terminal wires 1526. In one example, the terminal wires 1526 of the receptacle 1115 are connect by splicing with the circuit wires to provide 110 volts supply to both the receptacle and the DC charger. In other examples, the terminal wires 1526 may be connected to either the receptacle 1115 or the DC charger 1533.

FIGS. 42 A-42C show the DC charger 1533 attached or piggybacked to the backside of the GFCI/Decor receptacle 1115. One feature of having the receptacle built into the spool plate is to move the receptacle out of the electrical box so that there is more room in the electrical box for the DC charger 1533 to fit along with the circuit wires that fill up an electrical box.

Example—"All in One" Décor or GFCI Type Single Outlet with USB Top Ports

Figure 43B:
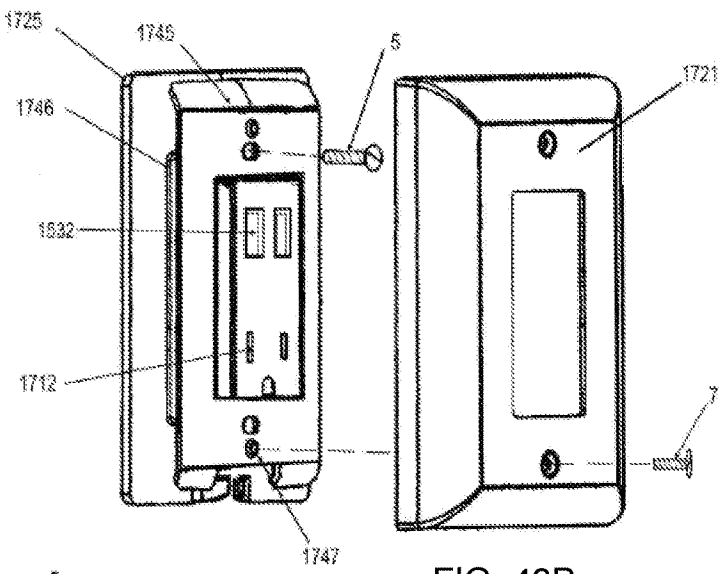
FIG. 43A shows a side view of the embodiment of an "all-in-one" device with USB power outlets, a single alternating power source outlet and a spool space.
FIG. 43 B shows a front perspective view of the "all-in-one" device of FIG. 43 A FIG. 43 C shows a rear perspective view of the embodiment of a "all-in-one" device of FIG. 43A.
Figure 43C:
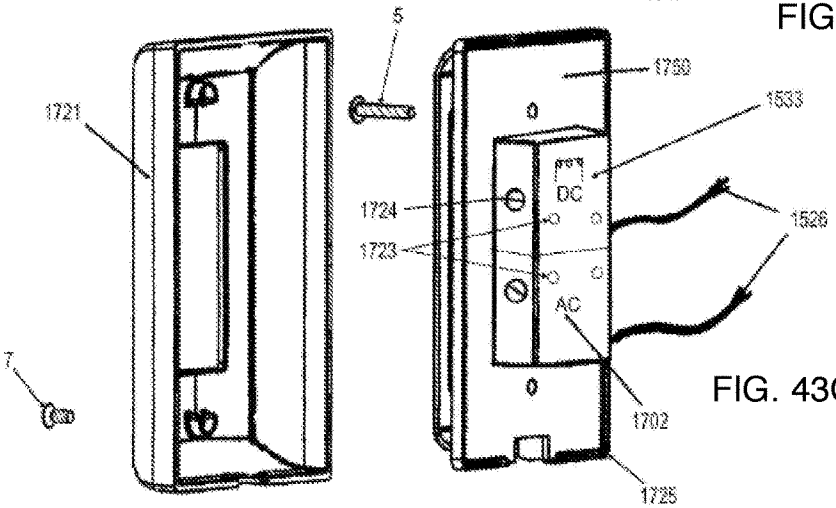
Figure 43A:
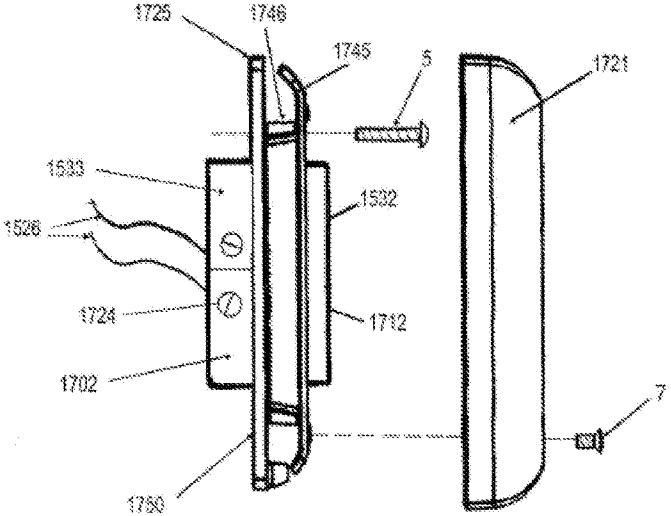

FIG. 43 A shows a side view of the embodiment of a "all-in-one" device 1725 comprising USB power outlets 1532, a single alternating power source outlet 1712 and a spool space 1746. Spool space 1746 is between rear backplate 1750 and front spool cover 1745. Spool space 1746 is primarily used for spooling excess wires from a cell phone cord or a small appliance cord. This "all-in-one" device 1725 has a rear backplate 1750 that surface mounts or attaches to any in-wall junction box (not shown) by two mounting screws 5. The outlet cover face plate 1721 is attached to the "all-in-one" device 1725 by two plate screws 7.

FIG. 43 B shows a front perspective view of the "all-in-one" device 1725 of FIG. 43 A, comprising USB power outlets 1532, a single alternating power source outlet 1712 and a spool space 1746 for spooling excess wires from a cell phone cord or a small appliance cord. The outlet cover face plate 1721 is attached to the "all-in-one" device 1725 by two plate screws 7 that screw into threaded holes 1747.

FIG. 43 C shows a rear perspective view of the embodiment of a "all-in-one" device 1725 of FIG. 43 A. The AC housing 1702 supplies circuitry for converting alternating current to the DC housing 1533 which supplies low voltage DC current to the USB power outlets 1532. This AC housing 1702 is supplied with 110 volts which is connected to terminal screws 1724 or terminal wires 1526 or by quick wire 1723. The AC housing 1702 also supplies voltage for the single alternating power source outlet 1712.

DESCRIPTION OF EMBODIMENT—COVER PLATE ASSEMBLY FOR "ALL-IN-ONE" UNITS

FIGS. 44 and 44 show examples of cover plate assemblies for all-in-one units.

Example—"All in One" Décor or GFCI Type Outlet

Figure 44B:
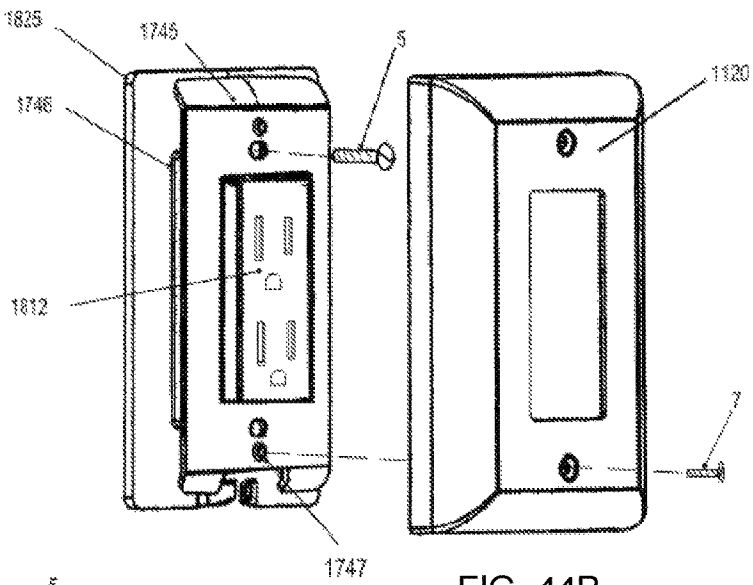
FIG. 44B shows a front perspective view of the "all-in-one" device of FIG. 44A
Figure 44C:
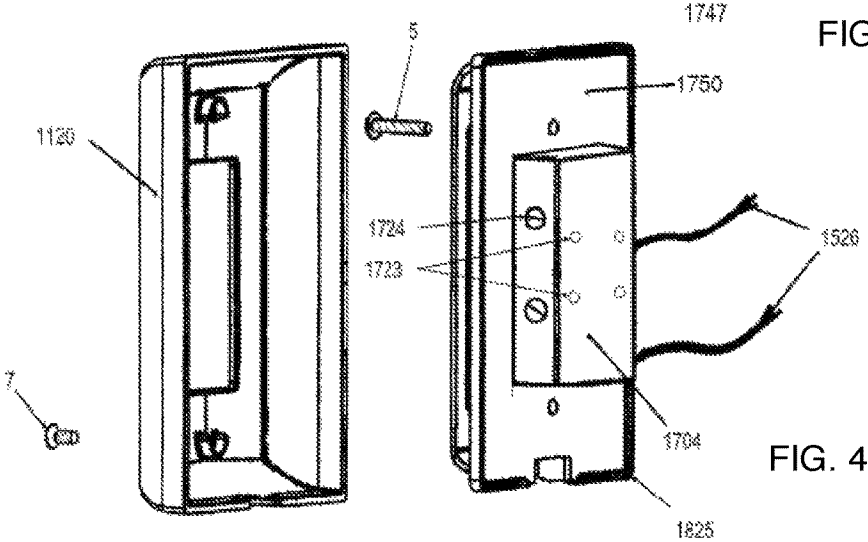
FIG. 44C shows a rear perspective view of the embodiment of a "all-in-one" device of FIG. 44 A.
Figure 44A:
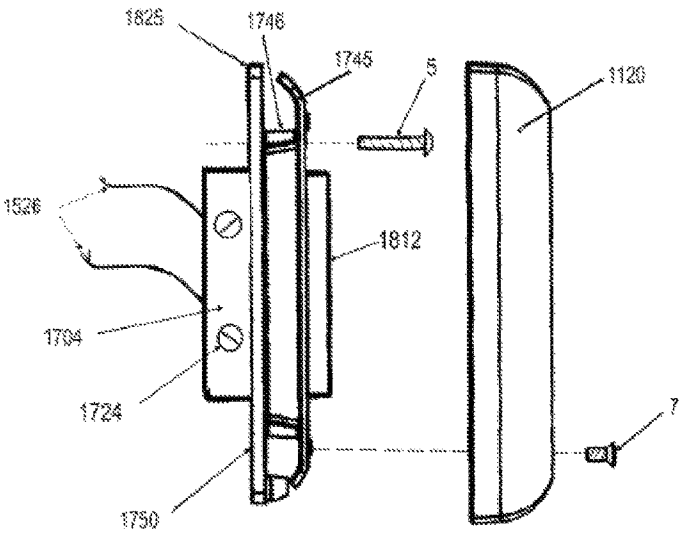
FIG. 44A shows a side view of the embodiment of a "all-in-one" device comprising an alternating power source outlet and a spool space.

FIG. 44A shows a side view of the embodiment of a "all-in-one" device 1825 comprising an alternating power source outlet 1812 and a spool space 1746. Spool space 1746 is between rear backplate 1750 and front spool cover 1745. Spool space 1746 is primarily used for spooling excess wires from a cell phone cord or a small appliance cord. This "all-in-one" device 1825 has a rear backplate 1750 that surface mounts or attaches to any in-wall junction box (not shown) by two mounting screws 5. The outlet cover face plate 1120 is attached to the "all-in-one" device 1825 by two plate screws 7.

FIG. 44B shows a front perspective view of the "all-in-one" device 1825 of FIG. 68A comprising a single alternating power source outlet 1812 and a spool space 1746 for spooling excess wires from a cell phone cord or a small appliance cord. The outlet cover face plate 1120 is attached to the "all-in-one" device 1825 by two plate screws 7 that screw into threaded holes 1747.

FIG. 44C shows a rear perspective view of the embodiment of a "all-in-one" device 1825 of FIG. 44A. The back of this device 1704 is supplied with 110 volts which is connected to terminal screws 1724 or terminal wires 1526 or by quick wire 1723.

Example—"All in One" Duplex Type Outlet

Figures 45A, 45B, 45C:
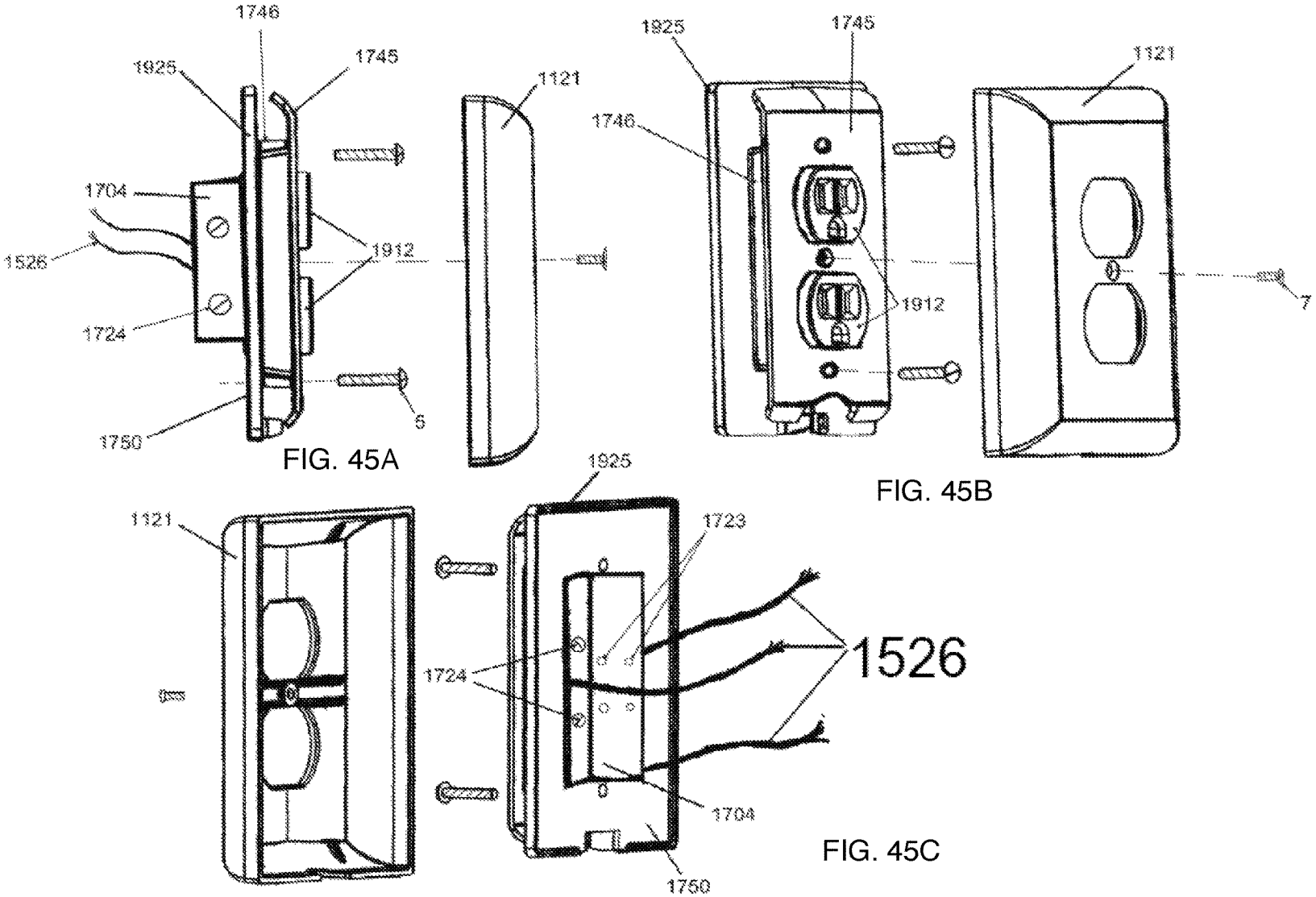
FIG. 45A shows a side view of the embodiment of a "all-in-one" device comprising an alternating power source outlet and a spool space.
FIG. 45B shows a front perspective view of the "all-in-one" device of FIG. 45A
FIG. 45C shows a rear perspective view of the embodiment of a "all-in-one" device of FIG. 45A.

FIG. 45A shows a side view of the embodiment of a "all-in-one" device 1925 comprising an alternating power source outlet 1912 and a spool space 1746. Spool space 1746 is between rear backplate 1750 and front spool cover 1745. Spool space 1746 is primarily used for spooling excess wires from a cell phone cord or a small appliance cord. This "all-in-one" device 1925 has a rear backplate 1750 that surface mounts or attaches to any in-wall junction box (not shown) by two mounting screws 5. The outlet cover face plate 1121 is attached to the "all-in-one" device 1925 by a single plate screw 7.

FIG. 45B shows a front perspective view of the "all-in-one" device 1925 of FIG. 69A comprising of a single alternating power source outlet 1912 and a spool space 1746 for spooling excess wires from a cell phone cord or a small appliance cord. The outlet cover face plate 1121 is attached to the "all-in-one" device 1925 by a single plate screw 7.

FIG. 45C shows a rear perspective view of the embodiment of a "all-in-one" device 1925 of FIG. 45A. The back of this device 1704 is supplied with 110 volts which is connected to terminal screws 1724 or terminal wires 1526 or by quick wire 1723.

DESCRIPTION OF EMBODIMENT—DOUBLE-GANG AND MULTIPLE-GANG DEVICES

The examples above show a cover for a single conventional electric outlet. The current invention is not limited to covers for single devices or to covers for electric outlets. The examples below describe a few on many other possibilities for concealing other types of cords and for having combinations of two or more outlets, telephone jacks, switches, computer cables, USB ports, etc.

Figure 18:
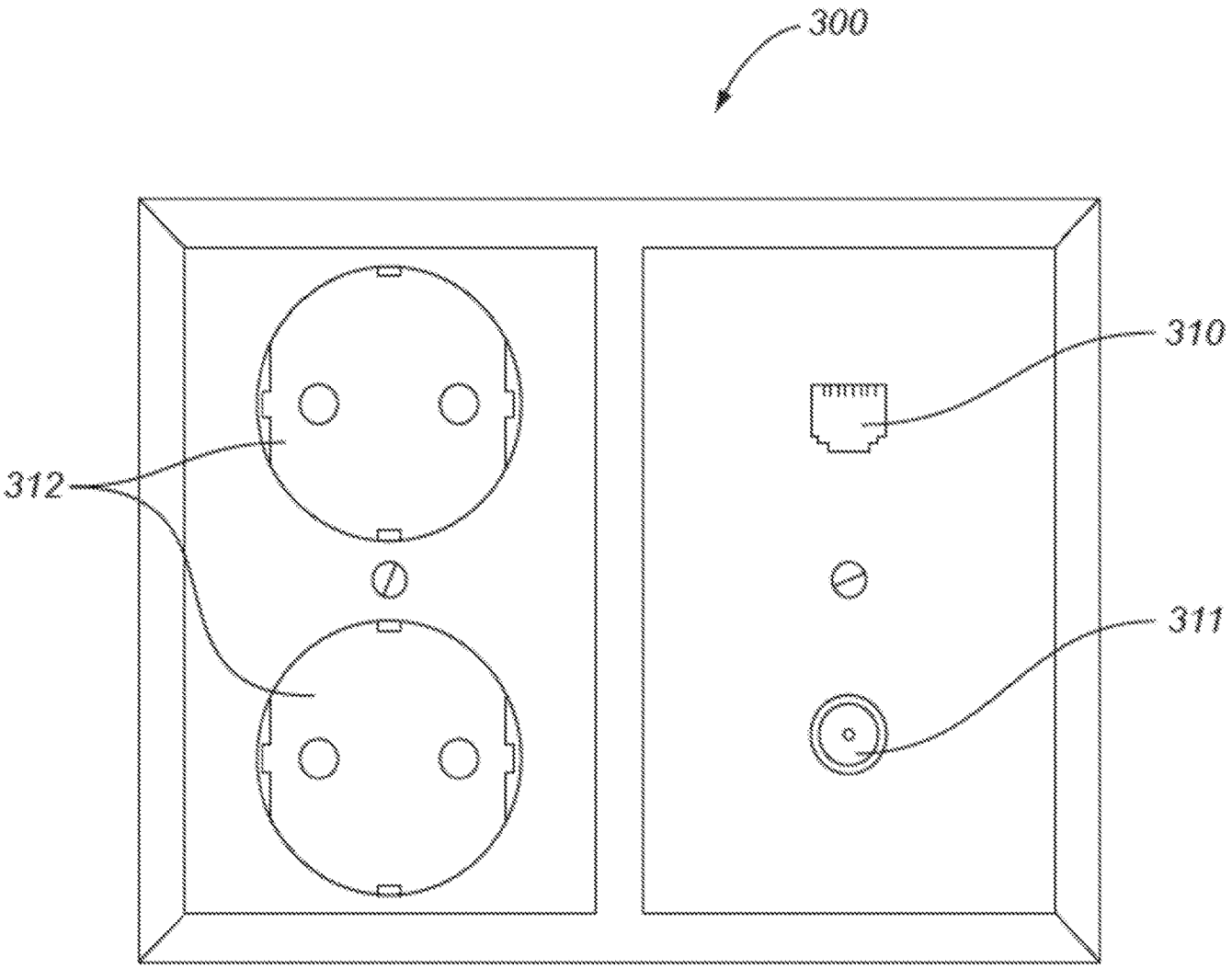
FIG. 18 illustrates a front view of an alternative double-gang embodiment of a cord storage device with alternative power and/or data connections.

FIG. 18 illustrates a front view of a double-gang embodiment. In this
illustration of a double-gang embodiment alternative power or communication link sockets/plugs are shown. These are shown merely as examples: a European type power socket 312; a phone or ethernet jack socket 310; and an optical or coaxial plug 311. It is not important to the invention whether the sockets and plugs are male or female, a combination or alternative connection type.

Figure 19:
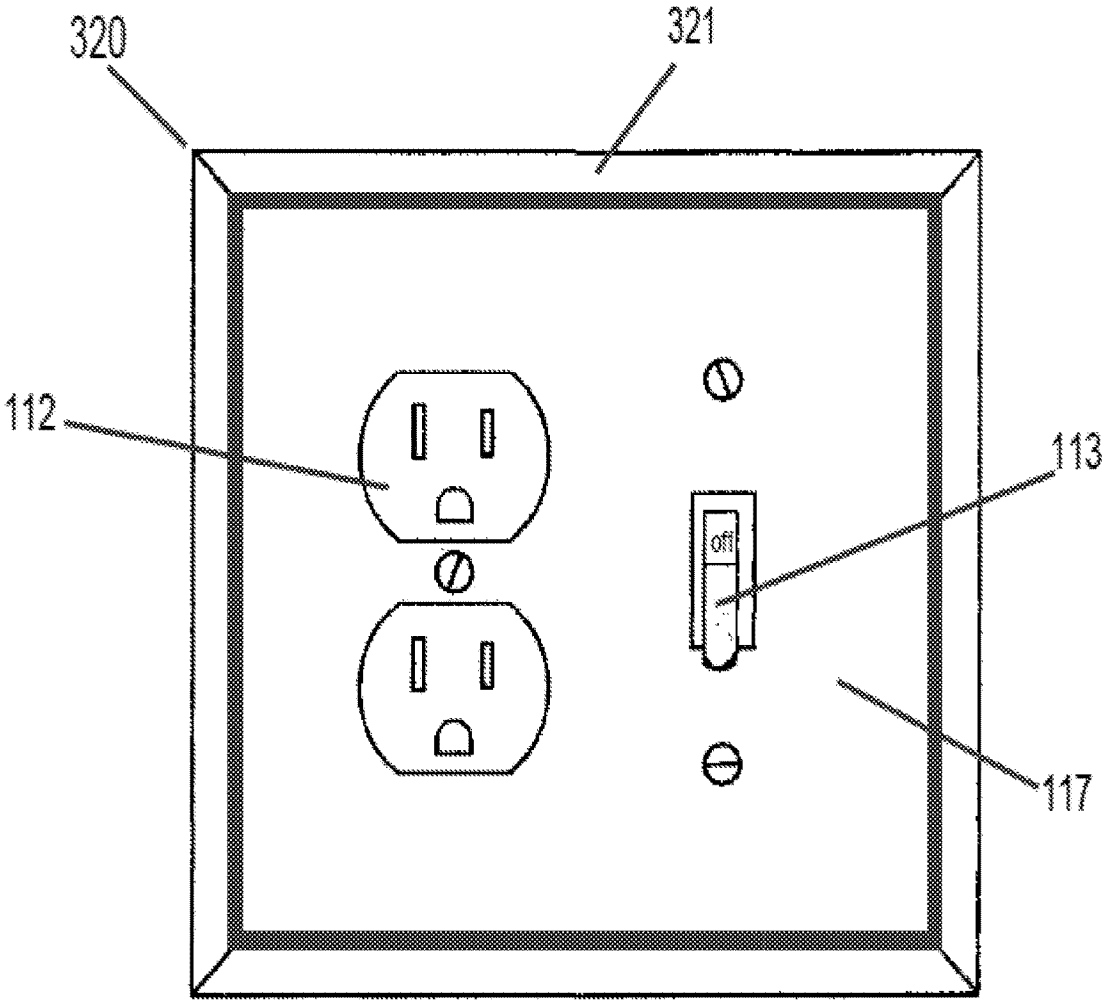
FIG. 19 illustrates a front view of yet another double gang embodiment where the power/or data receptacles are paired with a switch.

FIG. 19 illustrates another alternative double-gang assembly 320 combining power receptacle 112 or data receptacles with a switch 113 attached to a 2-gang combo plate 117 using back plate 322 (not shown) fitted to flange plate 321.

Figure 20:
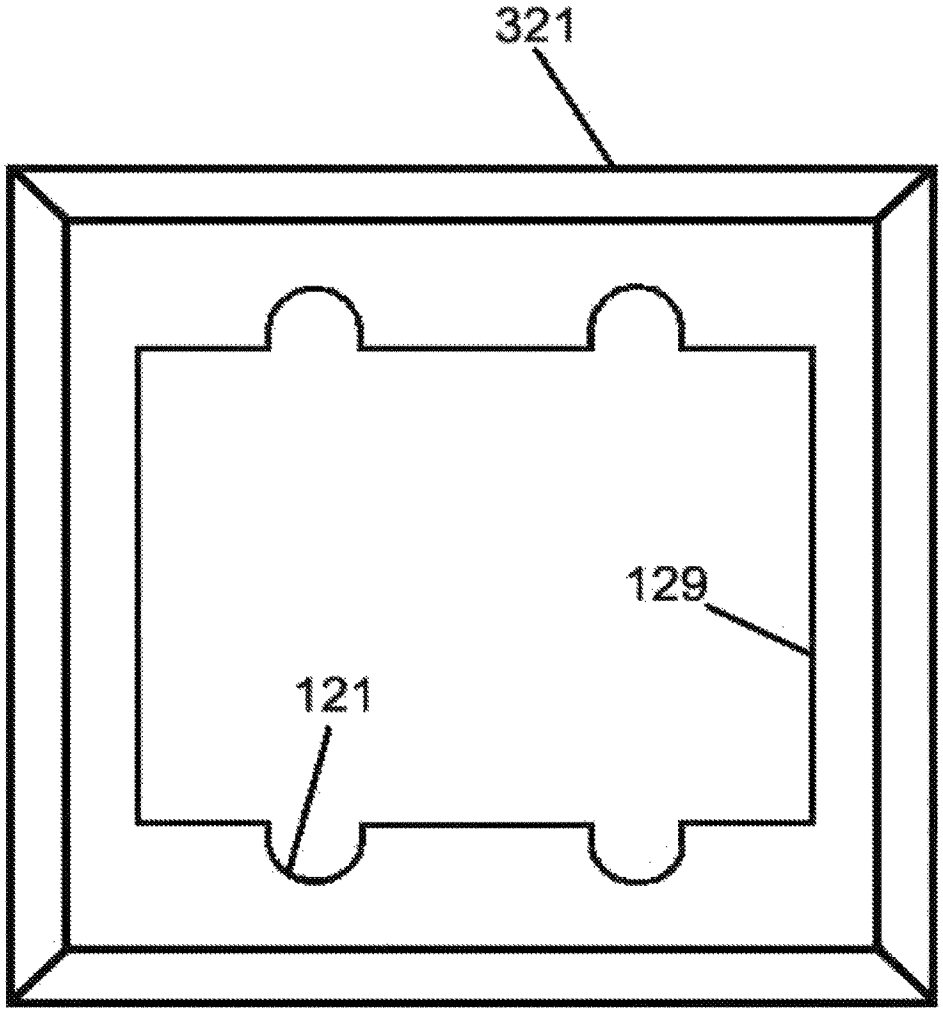
FIG. 20 illustrates a front view of a flange for double-gang embodiments such as those illustrated in FIG. 18 and FIG. 19.

FIG. 20 illustrates a flange plate 321 for the double-gang embodiments.

Figure 21:
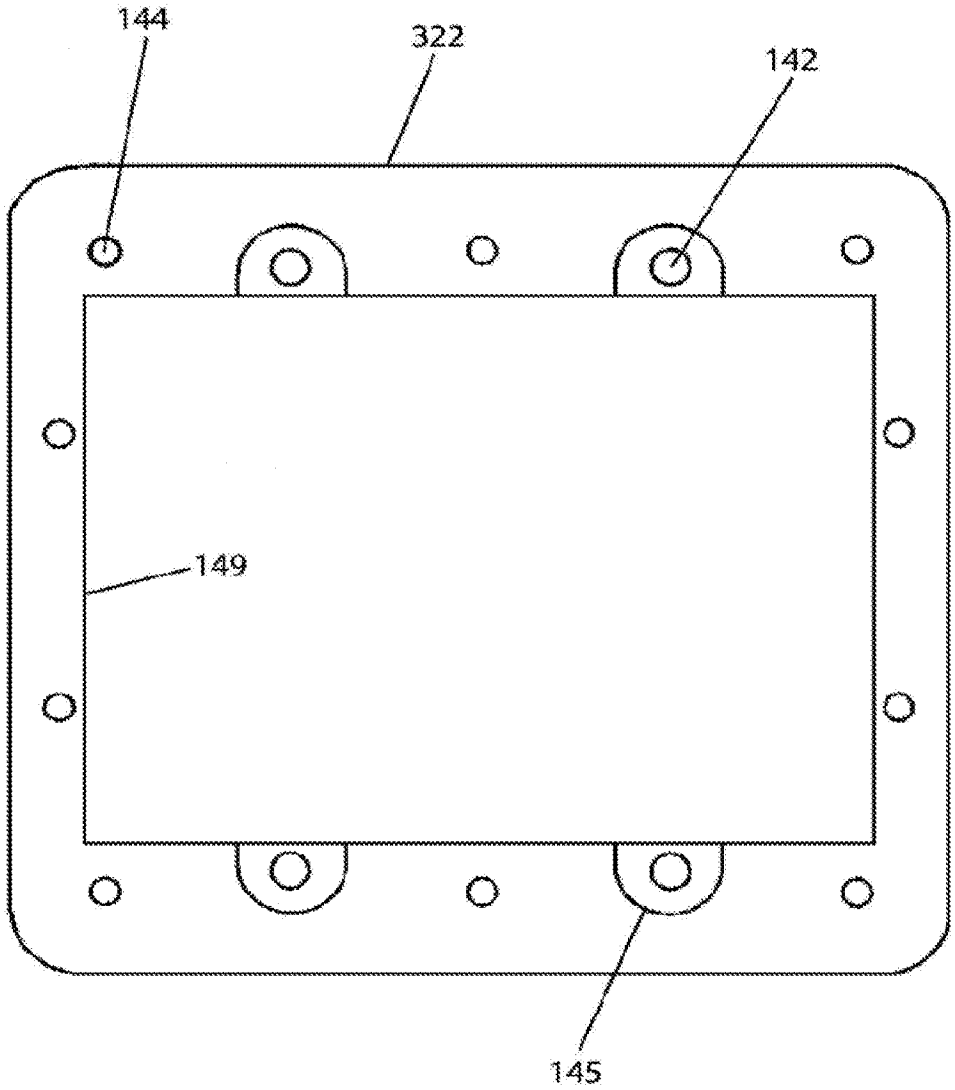
FIG. 21 illustrates a front view of a backplate for double-gang embodiments such as those illustrated in FIG. 18 and FIG. 19.

FIG. 21 illustrates a back plate 322 for a double-gang embodiment. It should be appreciated that embodiments are contemplated for other multiple gang implementations for example triple or quadruple gang embodiments and also for stacked gang embodiments.

Figure 36A:
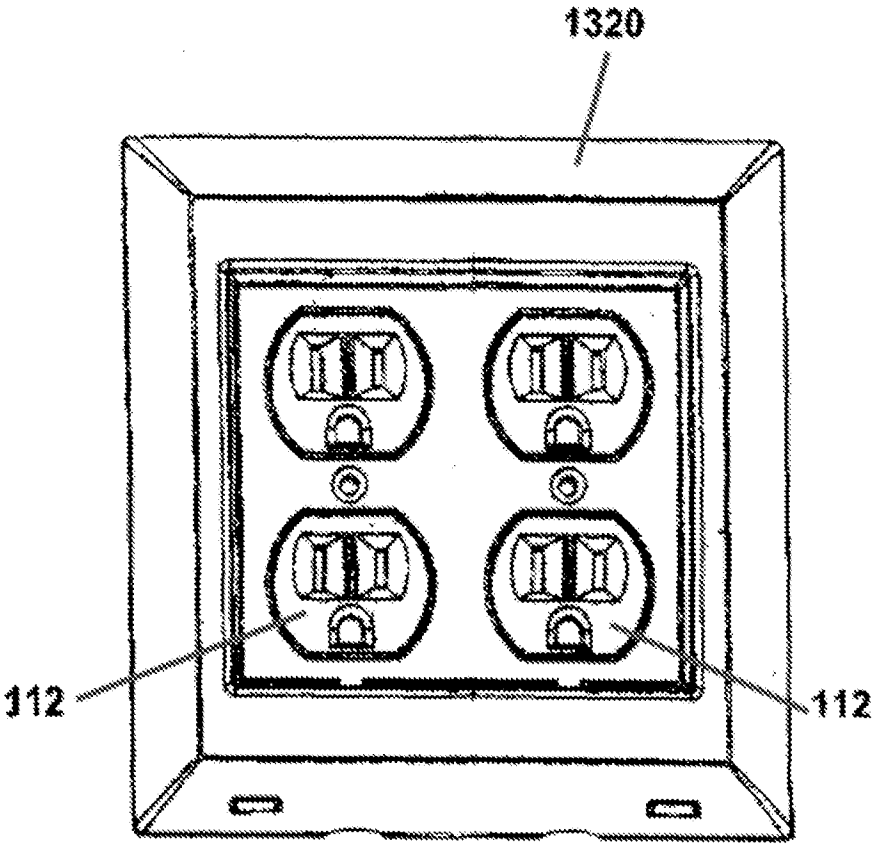
FIG. 36A is a front view of a recessed 2-gang receptacle cover plate assembly.
Figure 36B:
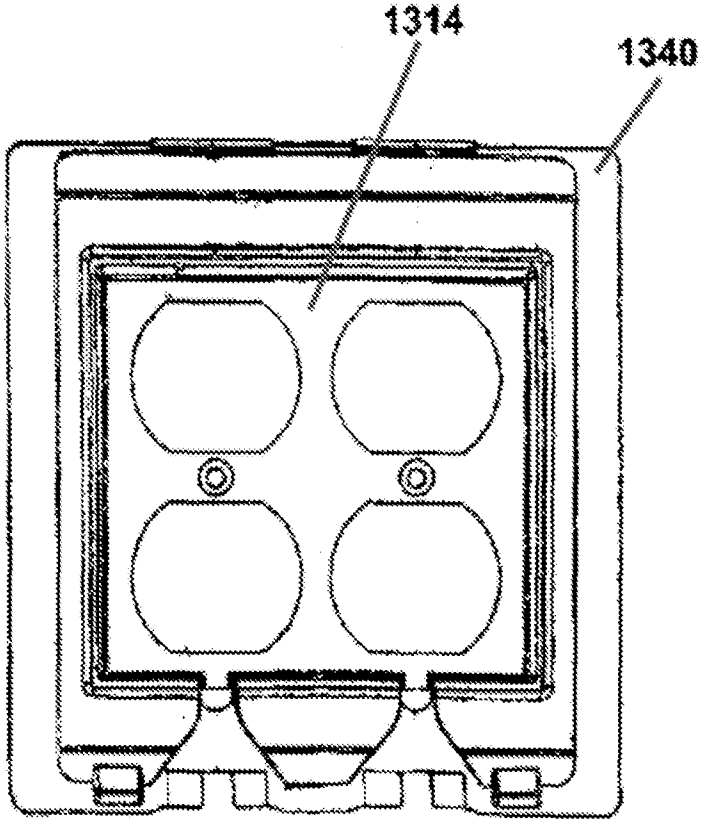
FIG. 36B is a front view of a spool plate for the embodiment of FIG. 36A.

FIG. 36A is a front view of a recessed 2-gang receptacle cover plate assembly showing a flange plate 1320 and two receptacles 112. FIG. 36B is a rear view of a combined spool plate 1340 and receptacle plate 1314 for the embodiment of FIG. 36A.

Figure 37A:
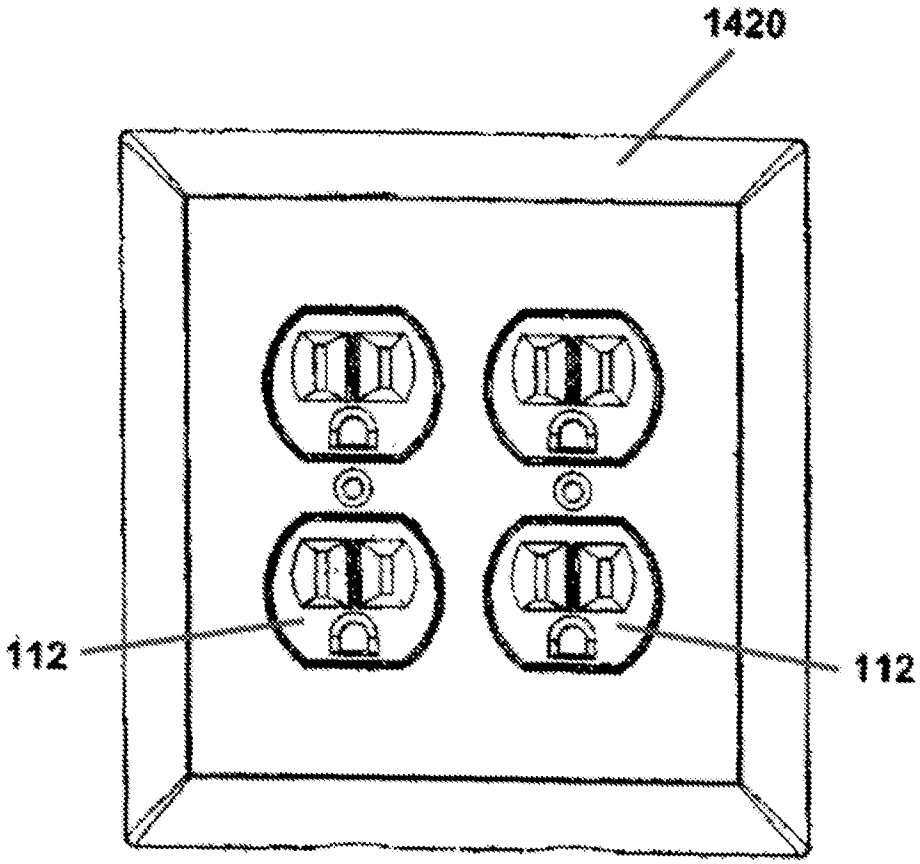
FIG. 37A is a front view of a flush 2-gang receptacle cover plate assembly.
Figure 37B:
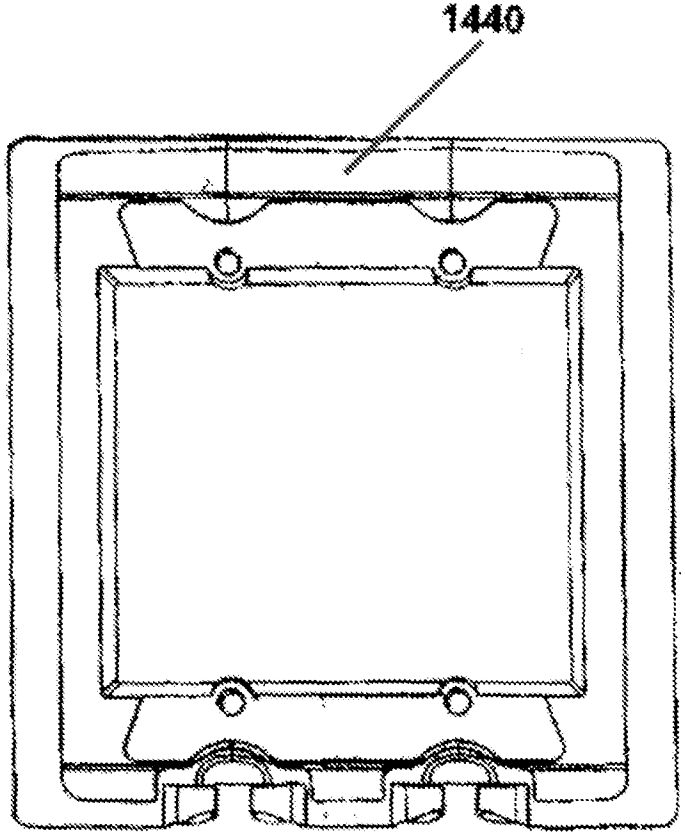
FIG. 37B is a front view of a spool plate for the embodiment of FIG. 37A.

FIG. 37A is a front view of a flush 2-gang receptacle cover plate assembly showing a flange plate 1420 and two receptacles 112. FIG. 37B is a front view of a spool plate 1440 for the embodiment of FIG. 37A.

Figure 38:
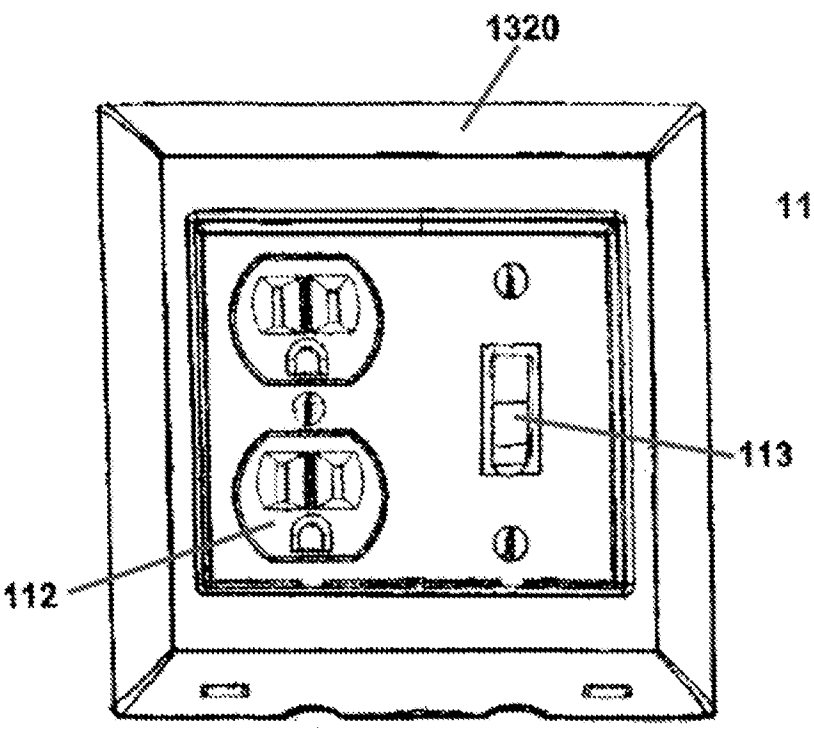
FIG. 38 is a front view of a recessed 2-gang receptacle cover plate assembly for a plug and a switch.

FIG. 38 is a front view of a recessed 2-gang receptacle cover plate assembly with a flange plate 1320 for a receptacle 112 and a switch 113.

Figure 39:
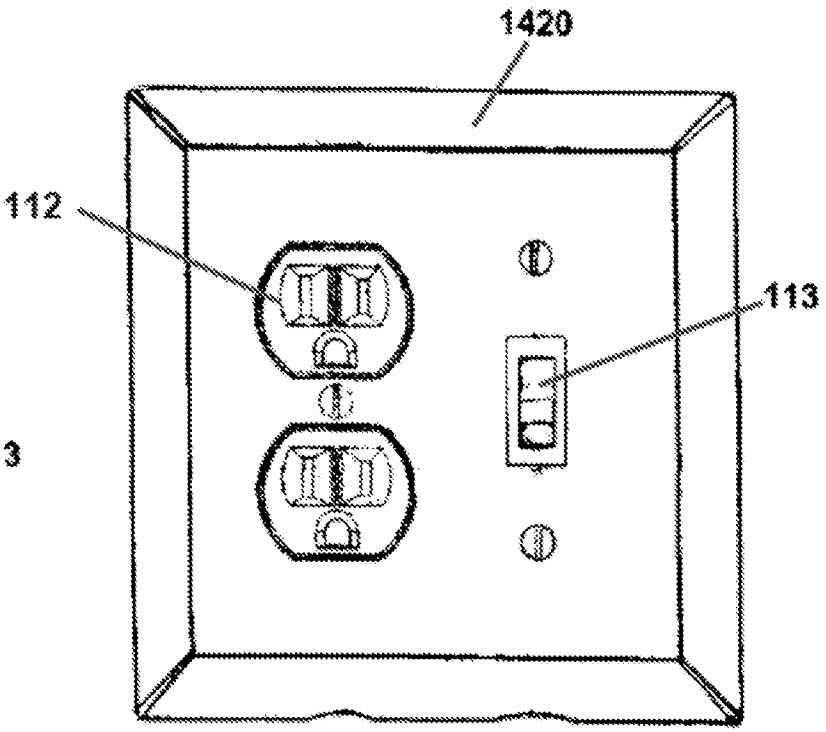
FIG. 39 is a front view of a flush 2-gang receptacle cover plate assembly for a plug and a switch.

FIG. 39 is a front view of a flush 2-gang receptacle cover plate assembly with a flange plate 1420 for a plug 112 and a switch 113.

While the disclosure has been described with respect to a limited number of embodiments, those skilled in the art, having benefit of this disclosure, will appreciate that other embodiments may be devised which do not depart from the scope of the disclosure as disclosed herein. The disclosure has been described in detail, it should be understood that various changes, substitutions and alterations can be made hereto without departing from the spirit and scope of the disclosure.

What is claimed is:

1. A receptacle and cover plate assembly for mounting in a receptacle box with respect to a wall, and to conceal a wrapped cord, the receptacle and cover plate assembly comprising a combined receptacle comprising
a first electrical outlet a combined receptacle cover plate and spool plate comprising a receptacle cover plate comprising a receptacle cover plate face integral to the combined receptacle, a spool cover plate offset from the receptacle cover plate face, the spool cover plate comprising
a spool front face, and
a spool cover recess comprising
a rectangular opening formed by top, bottom, and side walls projecting from the spool front face to the receptacle cover plate face, such that excess cord may be wrapped around outside of the top, bottom, and side walls of the rectangular opening; and a flange plate positioned over the combined receptacle cover plate and spool plate, the flange plate comprising
a front face,
a flange plate recess positioned at least partially inside the spool cover recess, the flange plate recess comprising
top, bottom, and side walls projecting from the front face to the rear of the front face, and
rearward angular flanges projecting from the top, bottom, and sides of the front face, the rearward angular flanges concealing the spool plate.

2. The receptacle and cover plate assembly of claim 1 wherein the combined receptacle cover plate and spool plate further comprises
an inwardly curved upper portion comprising
a top snap feature, and
an inwardly curved lowerportion comprising
a pair of spool plate tabs; and
the flange plate further comprises
a pair of flange plate openings on the bottom angular flange which are inserted over the pair of spool plate tabs.

3. The receptacle and cover plate assembly of claim 2 wherein the combined receptacle cover plate and spool plate further comprises a cord opening in the bottom of the recess window.

4. The receptacle and cover plate assembly of claim 2 wherein the spool cover plate further comprises a planar middle portion.

5. The receptacle and cover plate assembly of claim 2 wherein the inwardly curved lower portion of the spool plate further comprises a cord insertion slot which extends into the planar middle portion.

6. The receptacle and cover plate assembly of claim 1 wherein the flange plate is attached to the receptacle cover plate and spool plate with one or more top, bottom, or side hinge.

7. The receptacle and cover plate assembly of claim 1 wherein the all-in-one receptacle receptacle provides a single electric outlets, a DC charger, and two USB ports.

8. The receptacle and cover plate assembly of claim 7 wherein the all-in-one receptacle receptacle provides a pair of electric outlets, a DC charger, and two USB ports.

9. The receptacle and cover plate assembly of claim 7 wherein the all-in-one receptacle receptacle is a Decor or GFIC receptacle.

10. The receptacle and cover plate assembly of claim 8 wherein the DC charger is positioned behind the pair of electric outlets, and two USB ports are connected to the DC charger, and positioned beside the pair of electric outlets.

* * * * *